US008401439B2

(12) United States Patent
Saito et al.

(10) Patent No.: US 8,401,439 B2
(45) Date of Patent: Mar. 19, 2013

(54) IMAGE FORMING APPARATUS

(75) Inventors: Hiroyuki Saito, Tokyo (JP); Naoki Tajima, Sagamihara (JP); Seiko Itagaki, Hachioji (JP); Natsuko Minegishi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 120 days.

(21) Appl. No.: 12/963,567

(22) Filed: Dec. 8, 2010

(65) Prior Publication Data

US 2011/0170913 A1 Jul. 14, 2011

(30) Foreign Application Priority Data

Jan. 14, 2010 (JP) ..... 2010-005683
Mar. 12, 2010 (JP) ..... 2010-055577

(51) Int. Cl.
*G03G 15/095* (2006.01)

(52) U.S. Cl. ..... 399/264

(58) Field of Classification Search ..... 399/82, 399/264, 273
See application file for complete search history.

(56) References Cited

U.S. PATENT DOCUMENTS 6,035,169 A * 3/2000 Miyake et al. ..... 399/258
2009/0252544 A1* 10/2009 Kuribayashi ..... 399/350

FOREIGN PATENT DOCUMENTS

JP 05-066678 3/1993
JP 06-130820 5/1994
JP 11-237788 8/1999
JP 2007-072480 3/2007

OTHER PUBLICATIONS

Machine translation of Nametake (JP 2007072480 A listed in the IDS). Pub date, Mar. 22, 2007.*
Machine translation of Shirogata (JP 11327397 A). Pub date, Nov. 26, 1999.*

* cited by examiner

*Primary Examiner* — Walter L Lindsay, Jr.
*Assistant Examiner* — Frederick Wenderoth
(74) *Attorney, Agent, or Firm* — Squire Sanders (US) LLP

(57) ABSTRACT

The present invention realizes an image forming apparatus which is equipped with a carrier recovery section of simple configuration and for which maintenance is not required, the apparatus includes: a photoconductive drum; a developing device to develop a latent image formed on the photoconductive drum by a two-component developer containing a toner and a magnetic carrier, and a carrier recovery section which is equipped with a recovery roller, wherein the carrier recovery roller includes a rotatable sleeve, and a magnet roller that is installed inside the sleeve and provided with a plurality of fixed magnetic poles including a main pole to recover the magnetic carrier adhered onto the photoconductive drum and a separating pole to separate the magnetic carrier from the recovery roller, wherein a separating member is disposed at such a position that is opposite to the sleeve at a prescribed distance in a non-contact state.

12 Claims, 17 Drawing Sheets

IMAGE FORMING APPARATUS

This application is based on Japanese Patent Application No. 2010-005683 filed on Jan. 14, 2010, and No. 2010-055577 filed on Mar. 12, 2010 with the Japanese Patent Office, the entire content of which is hereby incorporated by reference.

TECHNICAL FIELD

The present invention relates to an electrophotographic image forming apparatus using a two-component developer containing at least a toner and a magnetic carrier.

BACKGROUND OF THE INVENTION

In an image forming apparatus that uses an electrophotographic process, an image is formed by developing a latent image borne on an image bearing member such as a photoconductor by using a toner to form a toner image and by transferring the toner image onto an image recording medium.

In a two-component developing method, there exists a problem that a magnetic carrier adheres onto the image bearing member. The magnetic carrier, adhered onto the image bearing member, is a possible cause of deterioration of the cleaning performance of a cleaning apparatus. Specifically, when the magnetic carrier adheres, because the magnetic carrier is pressed against the image bearing member at a transfer section to transfer a toner image, resulting in forming (causing) a raised area having a cratered shape around substantially the center of the section where the magnetic carrier is pressed onto the image bearing member. This raised area having a cratered shape damages the cleaning blade which constitutes a cleaning device and deteriorates the cleaning performance of the cleaning device. In other words, a toner slips beneath the cleaning blade and remains on the image bearing member as residual toner, forming streaky unevenness in the image which is formed in the subsequent image forming cycle.

As a countermeasure to the problem of magnetic carrier adherence, one means is to prevent the carrier adherence onto the image bearing member in the developing process, and another means is to recover the carrier which is adhered onto the image bearing member. Because the former means is known to be difficult to apply as the speed of image forming is increased, the latter means is widely applied.

Unexamined Japanese Patent Application Publication No. 1993-66678 (hereinafter referred to as Patent Document 1), Unexamined Japanese Patent Application Publication No. 1994-130820 (hereinafter referred to as Patent Document 2), Unexamined Japanese Patent Application Publication No. 1999-237788 (hereinafter referred to as Patent Document 3) and Japanese Patent No. 4010338 (hereinafter referred to as Patent Document 4) have disclosed apparatuses such that a magnet is disposed at such a position that is opposite to an image bearing member and the magnet removes, by magnetic attraction, the magnetic carrier which is adhered onto the image bearing member to recover the magnetic carrier. In the Patent Documents 1, 2, and 3, a roller which is rotatable and in which a roller-shaped magnet is installed is used and the magnet removes the magnetic carrier from the surface opposing the image bearing member. Then, recovery of the attracted magnetic carrier is attained by rotating the roller and separating the attracted magnetic carrier from a surface thereof, other than the surface which is opposite to the image bearing member.

In Patent Document 1, the separation of magnetic carrier attracted onto the roller is attained by a constitution wherein the magnet inside of the roller consists of a plurality of electromagnetic segments separated in the circumferential direction. In this constitution, it is configured such that at least one electromagnetic segment, which is not opposite to the image bearing member, is set to be inoperative while other electromagnetic segments are set to be operative so as to separate the attracted magnetic carrier from the electromagnetic segment which is not operative. In Patent Documents 2, 3 and 4, the magnetic carrier is separated by scraping the magnetic carrier from the surface of the roller with a scraper.

Patent Document 1 discloses a technique which is based on a constitution using a plurality of electromagnetic segments, resulting in the problem of increased complexity of control and apparatus, resulting in cost increase. Patent Documents 2 and 3 disclose techniques such that a scraper is contacted to the surface of the roller, resulting in occurrence of scratches on the surface of the roller by friction at each of such points of contact. Furthermore, when insulating toner is adhered to magnetic carrier, an insulating toner film is formed on the surface of the roller. Therefore, if it is configured so as to recover the magnetic carrier by creating an electric field between the roller and the image bearing member, the electronic field is altered by the toner film, resulting in degradation of carrier recovery performance, and thereby, a periodical maintenance and part replacement becomes necessary. Patent Document 2 also discloses a technique to recover the magnetic carrier by a recovery roller without using a scraper. However, elaborate arrangement of the magnetic pole of the recovery roller alone is insufficient to effect a high recovery of attracted carrier.

SUMMARY OF THE INVENTION

To achieve at least one of the abovementioned objects, an image forming apparatus reflecting one aspect of the present invention includes, for example:

an image bearing member;

a developing device to develop a latent image formed on the image bearing member by a two-component developer comprising a toner and a magnetic carrier;

a transfer section to transfer a toner image formed on the bearing member onto a receiving member, and a carrier recovery section which is equipped with a recovery roller, the recovery roller being arranged in the rotational direction of the image bearing member and being disposed at such a position that is opposite to the image bearing member in a non-contact state downstream of the developing device and upstream of the transfer section, and a separating member to guide the magnetic carrier separated from the recovery roller, wherein the carrier recovery roller comprises a sleeve which is rotatable, and a magnet roller that is installed into an inner space of the sleeve and is provided with a plurality of fixed magnetic poles, the plurality of fixed magnetic poles comprises a main pole to recover the magnetic carrier from the image bearing member and a separating pole to separate the magnetic carrier from the recovery roller, wherein the separating member is disposed at such a position that is opposite to the sleeve at a prescribed distance from the sleeve in a non-contact state.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

The present invention will be described based on preferred embodiments without the present invention being limited to the embodiments.

Figure 1:
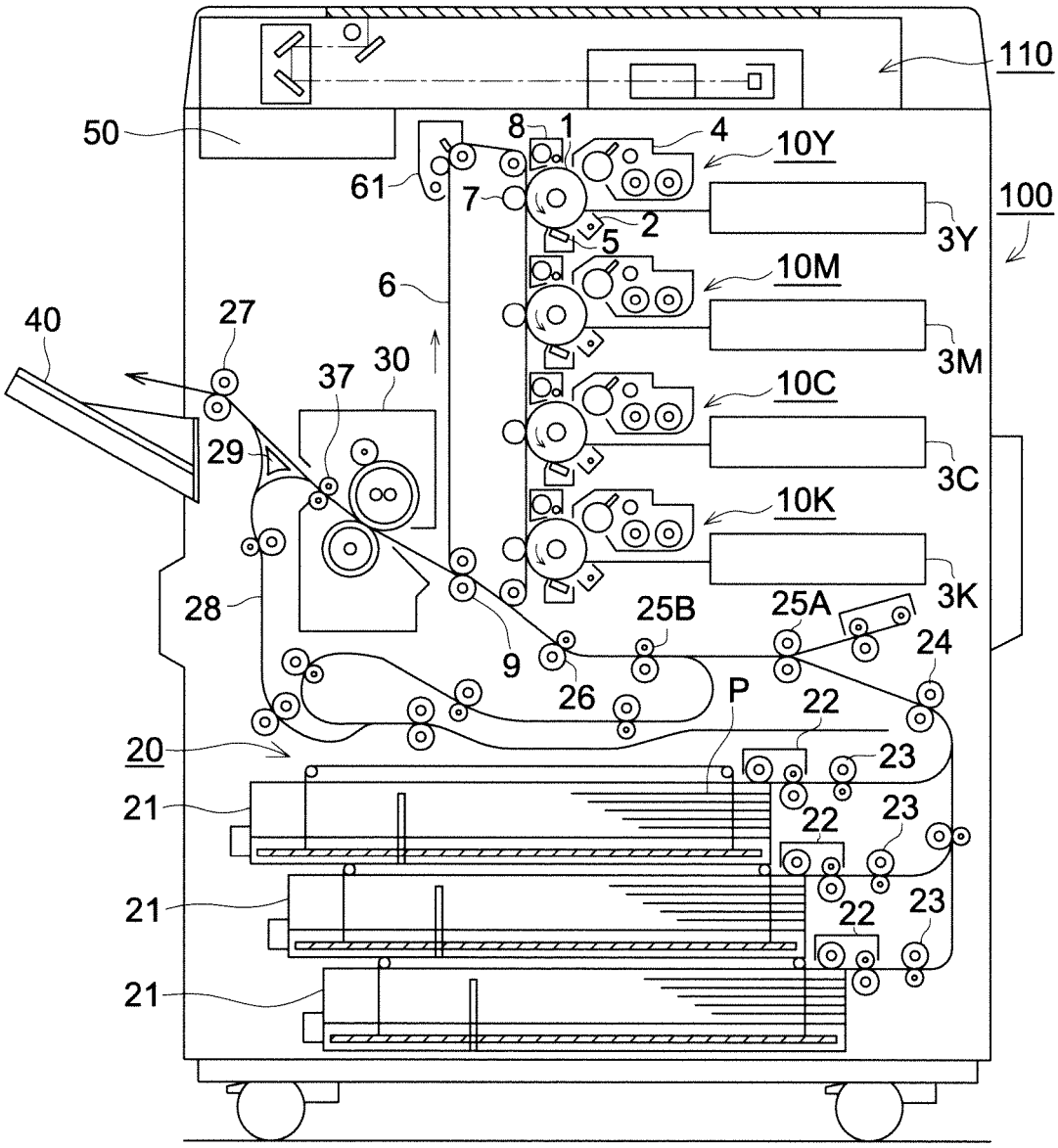
FIG. 1 is a cross-sectional diagram schematically showing an example of a configuration of a main section of an image forming apparatus according to an embodiment of the present invention.
Figure 2:
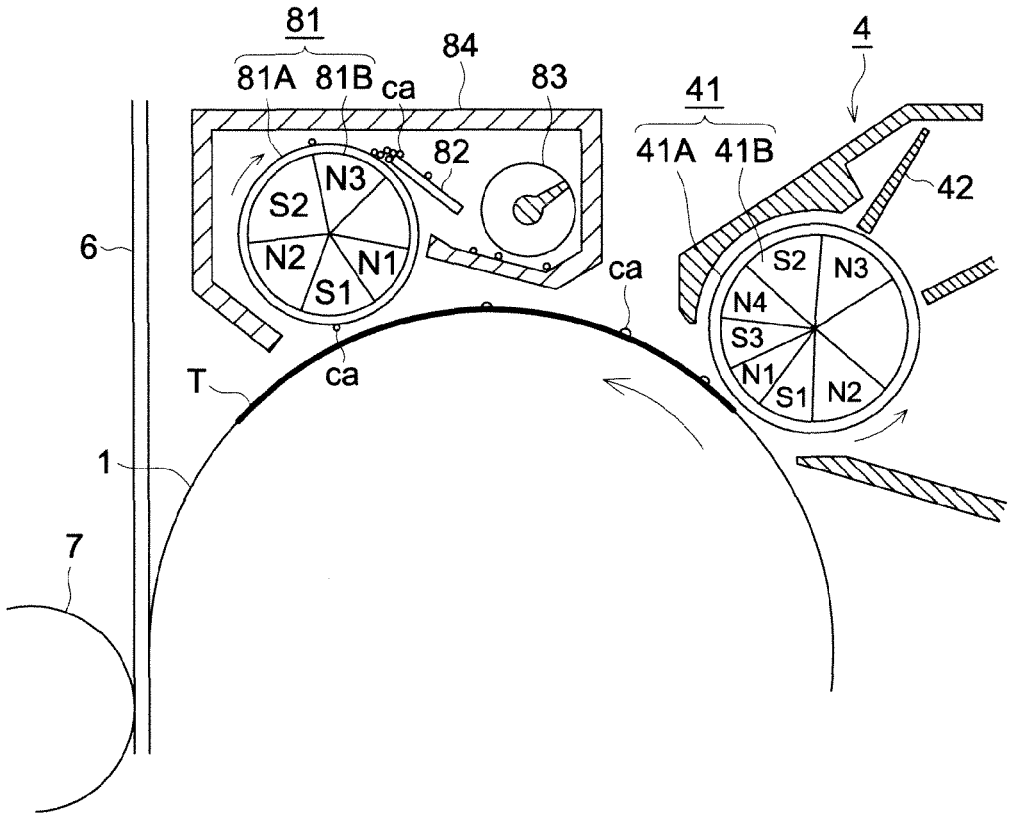
FIG. 2 is a cross-sectional diagram of carrier recovery section 8 and the circumstances thereof.

FIG. 1 is a cross-sectional diagram schematically showing an example of a configuration of a main section of an image forming apparatus according to a first embodiment of the present invention. FIG. 2 is an enlarged cross-sectional diagram of carrier recovery section 8 and the circumstances thereof. Image forming apparatus 100 is a so called a tandem method image forming apparatus configured with a plurality of sets of image forming devices 10Y, 10M, 10C and 10K, an intermediate transfer belt 6, a sheet feeding device 20 and a fixing device 30. Meanwhile, in the present specification, the elements are denoted collectively by reference symbols having no alphabetic suffix and elements of individual colors are denoted by reference symbols having the suffixes i.e. Y (yellow), M (magenta), C (cyan) and K (black).

At an upper portion of image forming apparatus 100, scanner 110 is disposed. A document placed on a platen is scanned through an optical system of a document image scanning exposure device of scanner 110 and read by a line image sensor. An analogue signal having been subject to photoelectric conversion through the line image sensor is inputted to exposure sections 3Y, 3M, 3C and 3K after analogue processing, A/D conversion, shading correction, and image compression processing have been carried out.

Control section 50 is provided with a CPU, a ROM and a RAM. In the ROM, various kinds of programs are stored and a program downloaded to the RAM is executed by the CPU.

Image forming device 10Y to form a yellow color image, image forming device 10M to form a magenta color image, image forming device 10C to form a cyan color image, and image forming device 10K to form a black color image, each of which is provided with charging electrode 2, exposure section 3, developing section 4, cleaning section 5 and carrier recovery section 8 arranged around the periphery of photoconductor 1 in a shape of a drum representing a image bearing member (in FIG. 1 reference symbols for M, C, and K are omitted). Hereinafter, those are collectively called image forming section 10.

Each of the developing devices of developing device 4 accommodates two component developer including fine particle toner whose color is the corresponding one of color Y, color M, color C, and color K, and carriers. Specifically, the two component developing agent includes carriers, each particle of which is a ferrite core coated with an insulating resin material, and toner that includes polyester as its main ingredients and various kinds of additives including a coloring agent such as a pigment, a carbon black, etc., a charge controlling agent, a silica, a titanium oxide, etc. The particle diameter of the carriers is set at a value in the range of 10 to 50

μm. On the other hand, the particle diameter of the toner is set at a value in the range of 4 to 10 μm, while the charging characteristic of the toner is a negative charging characteristic and the average charge amount is set at a value in a range of −20 to −60 μC/g. Further, the present embodiment employs such a two-component developing agent that includes the above-specified carriers and toner, which are mixed with each other so as to set the toner density at a value in a range of 4 to 10%/mass (percentage by mass).

Developing roller 41 of developing section 4, being disposed at such a position that is opposite to photoconductor 1, consists of developing sleeve 41A, of which outer surface is rotatable, and magnetic roller 41B which is installed into inner space of developing sleeve 41A. Magnetic roller 41B is provided with a plurality of fixed magnetic poles, such as developing pole N1 and other magnetic poles such as S1, N2, N3, S2, N4 and S3. On the surface of developing sleeve 41, a layer of developer, of which the thickness is regulated to a constant thickness by thickness regulating plate 42, is retained and the layer of developer is conveyed to such a position that is opposite to photoconductor 1, and the latent image formed on the image bearing member is developed by a developing electronic field generated by a power supply (not shown in the drawings).

Intermediate transfer belt 6 is supported rotatably by a plurality of rollers. Intermediate transfer belt 6 is an endless belt having a volume resistivity of $10^6$ to $10^{12}$ Ωcm (ohm centimeter) and is, for example, a semi-conductive seamless belt having a thickness of 0.04 to 0.10 mm wherein a conductive material is dispersed in engineering plastics such as modified polyimide, thermal curing polyimide, ethylene tetrafluoroethylene copolymer, polyvinylidene-fluoride and nylon alloy.

Toner images of individual colors formed on photoconductor 1 by image forming devices 10Y, 10M, 10C and 10K are successively transferred onto intermediate transfer belt 6 (primary transfer) through primary rollers 7Y, 7M, 7C and 7K (hereinafter collectively called primary rollers 7) to serve as a primary transfer section so as to form a combined color image. On the other hand, after image transfer, residual toner on photoconductor 1 (1Y, 1M, 1C and 1K) is removed by cleaning section 5 of each color.

Sheet P stored in sheet storing section (tray) 21 of sheet feeding device 20 is fed through first sheet feeding section 22, and conveyed to secondary transfer roller 9 which serves as a "secondary transfer section" via sheet feeding rollers 23, 24, 25A, and 25B and a registration roller (secondary sheet feeding section) 26, then the color image is transferred onto sheet P (secondary transfer).

Since three-tiered sheet storing sections 21, disposed in a vertical direction in parallel at a lower portion of image forming apparatus 100, have substantially the same configuration, they are denoted by the same reference symbols. Further, since configurations of sheet feeding sections 22, which are respectively incorporated into the three stages of sheet storing sections 21, are substantially the same, as well, so that they are denoted by the same reference symbols. Hereinafter, sheet storing sections 21, including sheet feeding section 22, is called sheet feeding device 20.

Successively, sheet P, on which the color toner image has been transferred, is further conveyed into fixing device 30, in which sheet P is tightly nipped by a pair of fixing rollers so as to apply heat and pressure onto both sheet P and the color toner image (or toner image), to fix the color toner image (or toner image) onto sheet P. Still more successively, sheet P, on which the color toner image (or toner image) is fixed, is nipped and conveyed by paired conveyance roller 37 and ejected through paired ejecting roller 27 onto ejecting tray 40 disposed outside the apparatus.

On the other hand, after the color toner image (or toner image) has been transferred onto sheet P from intermediate transfer belt 6 by secondary transfer roller 9 and sheet P has been curvature-separated from intermediate transfer belt 6, cleaning section 69 removes any residual toner remaining on intermediate transfer belt.

In case both surfaces of sheet S are to be printed, after fixing the image fainted on the first surface of sheet S, sheet S is branched off from the ejection sheet conveyance path via branching plate 29 and guided into double-sided conveyance path 28, then sheet S is flipped upside down, after that sheet S is conveyed from sheet feeding roller 25B. On the second surface of sheet S, an image of each color is formed through each of image forming devices 10Y, 10M, 10C and 10K, whereby images are formed on both the surfaces of sheet S. Then sheet S is subject to the pressure heat fixing process via fixing device 30 and ejected outside the apparatus via ejection roller pair 27.

In this first embodiment of the present invention, photoconductor 1 functions as an image bearing member, and primary transfer roller 7 functions as a transfer section for photoconductor 1 and transfers the toner image onto intermediate transfer belt 6 which functions as a receiving member.

[Carrier Recovery Section 8]

Figure 3:
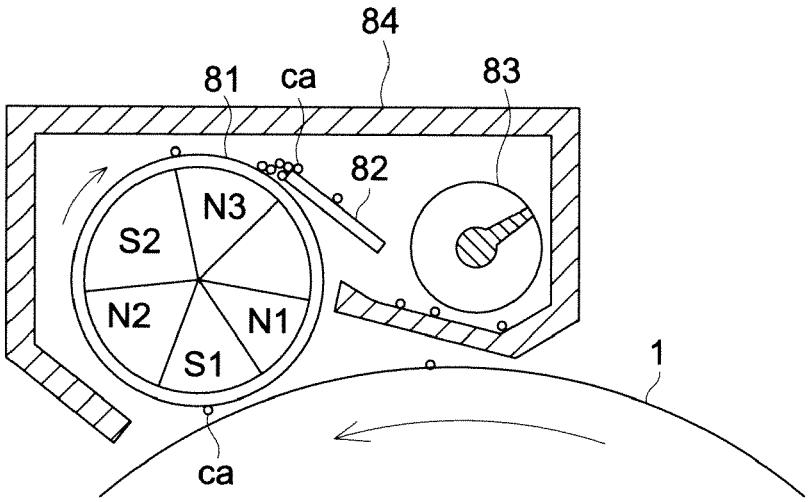
FIG. 3 is a cross-sectional diagram of carrier recovery section 8.
Figure 4:
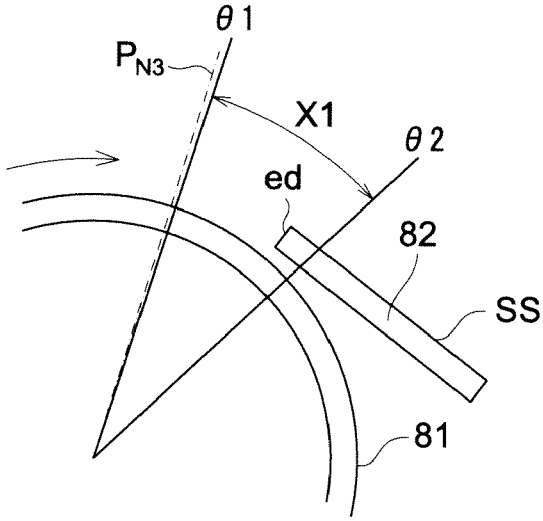
FIG. 4 is an enlarged figure of FIG. 3.

The configuration of carrier recovery section 8 will be now described in accordance with FIGS. 2, 3 and 4. FIG. 2 is a cross-sectional diagram of carrier recovery section 8 and the circumstances thereof. FIG. 3 is a cross-sectional diagram of carrier recovery section 8. As shown in FIG. 2, carrier recovery section 8 consists of recovery roller 81, separating member 82, conveyance screw 83, and chassis 84. Magnetic carrier "Ca" adhered, together with toner image "T", onto photoconductor 1 is recovered by carrier recovery section 8. Recovery roller 81 consists of sleeve 81A which is the rotatable outer surface of recovery roller 81, and magnet roller 81B which is installed inside sleeve 81A, and the recovery roller which is disposed in such a position that is opposite to photoconductor 1 at a subscribed distance from photoconductor 1. The rotational direction of sleeve 81A (hereinafter referred to also as "the rotational direction of recovery roller 81") is clockwise direction as shown in FIGS. 2 and 3. The rotational axes of recovery roller 81 and conveyance screw 83 are parallel (hereinafter referred to as "the direction of rotational axis"), and separating member 82 extends along the direction of rotational axis. Sleeve 81A may be grounded. In this embodiment, a DC voltage, of which the polarity is the reverse of the polarity of electrical charge of the magnetic carrier, is applied to sleeve 81A. Furthermore, an AC voltage may be superimposed onto the DC voltage.

In this embodiment, a plurality of magnetic poles (N1, S1, N2, S2, and N3) is arranged on magnet roller 81B. In case of the example shown in FIGS. 2 and 3, the magnetic pole that is opposite to photoconductor 1 is main pole S1 which pole recovers magnetic carrier "ca" from photoconductor 1. Poles downstream of main pole S1 in the rotational direction of recovery roller 81, are pole N2, pole S2 and separating pole N3, and separating member 82 is disposed at such a position that it is opposite to separating pole N3 at a subscribed distance from sleeve 81A in a non-contact state. The subscribed distance is, for example, from 0.1 to 0.3 mm.

Magnetic carrier "Ca", recovered by main pole S1, is separated by separating pole N3, and stored in the magnetic field formed between separating member 82 and separating pole N3. Some of the stored magnetic carrier "ca" are dropped downward and are conveyed by conveyance screw 83 in the direction of rotational axis and are discharged into a discharge box (not shown in the drawings) outside.

Separating member 82 is disposed at such a position that it is opposite to sleeve 81A at a subscribed distance from sleeve 81A in a non-contact state so that end "ed" of separating member 82 (refer to FIG. 4 which is an enlarged figure of FIG. 3) is disposed in the magnetic field of separating pole N3. In the near-field region of separating pole N3, magnetic carrier "ca" can be separated more easily because the binding force of recovery roller 81 against magnetic carrier "ca" becomes reduced as magnetic force Fr in the normal direction becomes reduced due to the positional relationship of neighboring pole N1 which is the same polarity as separation pole N3.

Also, separating member 82 is, as shown in FIG. 4, arranged so that end "ed" thereof, adjacent to recovery roller 81 (sleeve 81A), faces in the opposite direction of the rotational direction of recovery roller 81, in other words, the end "ed" faces the upstream side of the rotational direction of recovery roller 81. With this configuration, magnetic carrier "ca" can be separated from recovery roller 81 without resistance to the inertia force of magnetic carrier "ca" which is conveyed on the surface of sleeve 81A. Also, by arranging inclined surface SS of separating member 82 to be approximately parallel to the tangential direction of sleeve 81A at the position of separating pole N3, magnetic carrier "ca" can be separated by using the centrifugal force to which magnetic carrier "ca" is subjected.

End "ed" which is adjacent to recovery roller 81 is disposed at such a position that it is opposite to separating pole N3. However, it is preferable that end "ed" be disposed in the magnetic field of separating pole N3 and in domain X1 which is downstream of pole position $P_{N3}$ of magnetic flux density Br in the normal direction of separating pole N3 on the surface of sleeve 81A, as shown in FIG. 4. Magnetic carrier "ca" is conveyed along the surface of sleeve 81A in the direction of rotation, and magnetic carrier "ca" moving on the surface of sleeve 81A tends to accumulate at each magnetic pole position, and thereby, the density of magnetic carrier "ca" tends to be higher at each pole position and be lower between the pole positions. This is due to the distribution of magnetic force Fr in the normal direction and magnetic force Fθ in tangential direction, on the surface of sleeve 81A. By arranging end "ed" of separating member 82 to be in domain X1, magnetic carrier "Ca", being stored at the position of separating pole N3, can be separated more efficiently.

Figure 5A:
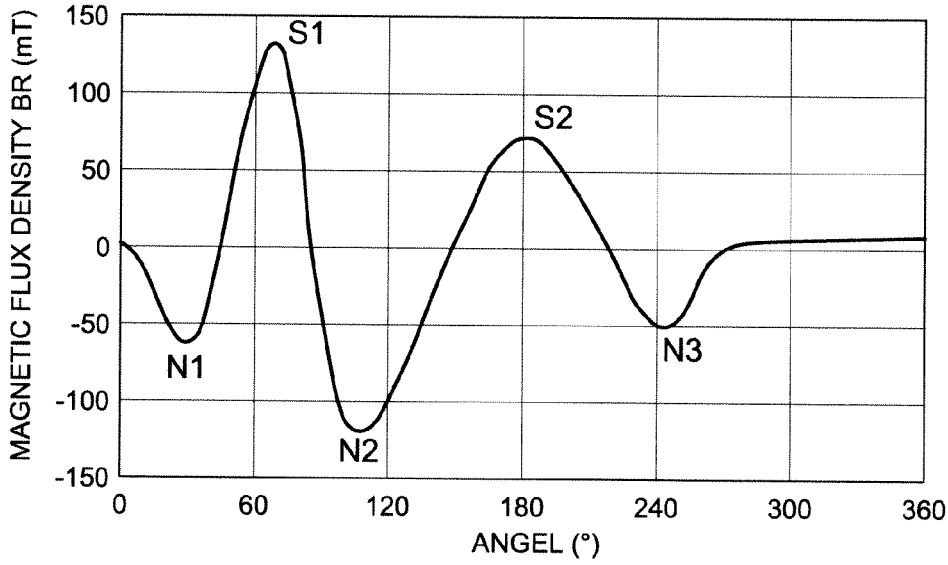
FIGS. 5*a* and 5*b* are each a view showing the distribution of magnetic flux density Br in the normal direction on the surface of recovery roller 81.
Figure 5B:
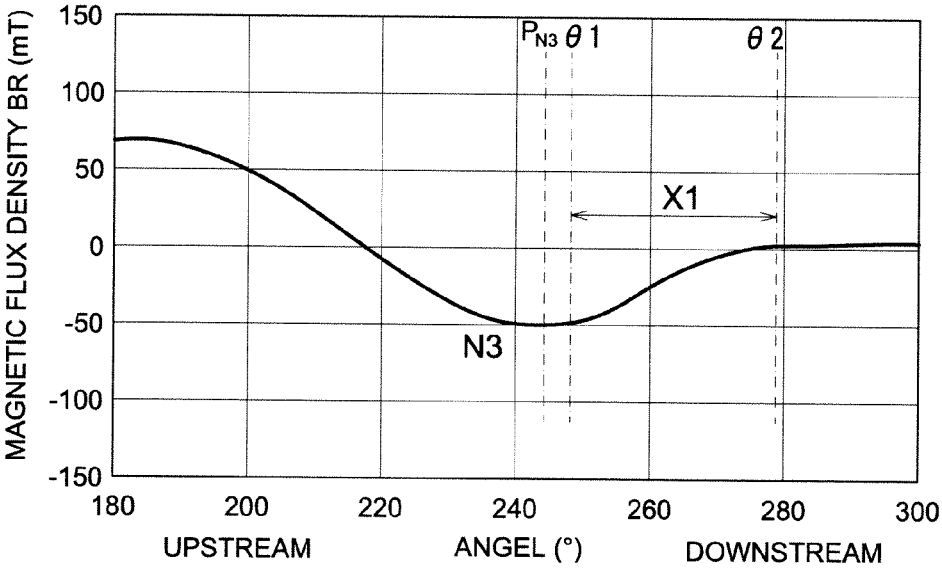

FIGS. 5*a* and 5*b* are each a view showing the distribution of magnetic flux density Br in the normal direction on the surface of recovery roller 81. The abscissa axis represents angle (°), and the ordinate axis represents magnetic flux density Br (mT). FIG. 5*a* is a view showing the distribution of magnetic flux density Br of the entire periphery of separating pole N3. FIG. 5*b* is an enlarged view showing the distribution of magnetic flux density Br of periphery of separation pole N3. Pole position $P_{N3}$, angles θ1 and θ2, domain X1 in FIG. 5 corresponds to these in FIG. 4, respectively. As a definition of pole position $P_{N3}$, for example, the center position of half-value width of the peak value of magnetic flux density Br of separating pole N3, or the center position of 80% value width of magnetic flux density Br can be used.

Domain X1 is the area where end "ed" of separating member 82 is located in the magnetic field generated by separating pole N3 and the area downstream of separating pole N3 in the rotational direction of sleeve 81A. Domain X1 is the area surrounded by angle θ1 in the upstream end and angle θ2 in the downstream end. Angle θ1 does not include pole position $P_{N3}$ and is angle downstream of pole position $P_{N3}$. Angle θ1 is, for example, 0.1° to 1.0° downstream of pole position $P_{N3}$. Angle θ2 is boundary position downstream, and in this embodiment, Angle θ2 is set to be 30° downstream of pole position $P_{N3}$. In the present invention, the description of "in the magnetic field generated by separation pole N3" means "the area where magnetic filed of separating member N3 exerts an influence and the absolute value of magnetic flux density Br in approximately the tangential direction is larger than zero, and in the radial direction, the area is within a few millimeters from the surface of sleeve 81A. Because magnetic force Fr in the normal direction on the surface of sleeve 81A becomes reduced in this domain, magnetic carrier "ca" can be separated more easily.

When it is arranged so that separating member 82 and recovery roller 81 are in contact with each other, scarring, on the surface of the recovery roller, due to the friction at the point of contact tends to occur. Also, if insulating toner, having been attached to magnetic carrier, is adhered to the surface of recovery roller due to the friction on the surface thereof, a layer of the adhered insulating toner will be formed on the surface thereof. In the configuration in which magnetic carrier is recovered by generating magnetic field between a recovery roller and image bearing member, the magnetic field will be influenced by the toner layer. Due to the above described influence, the performance of carrier recovery is deteriorated, and a periodical maintenance and part replacement become necessary. In this embodiment, because separating member 82 and recovery roller 81 are arranged to be in a non-contact state, the configuration for carrier recovery is simple and requires no periodical maintenance or part replacement.

Other Embodiments

Figure 6:
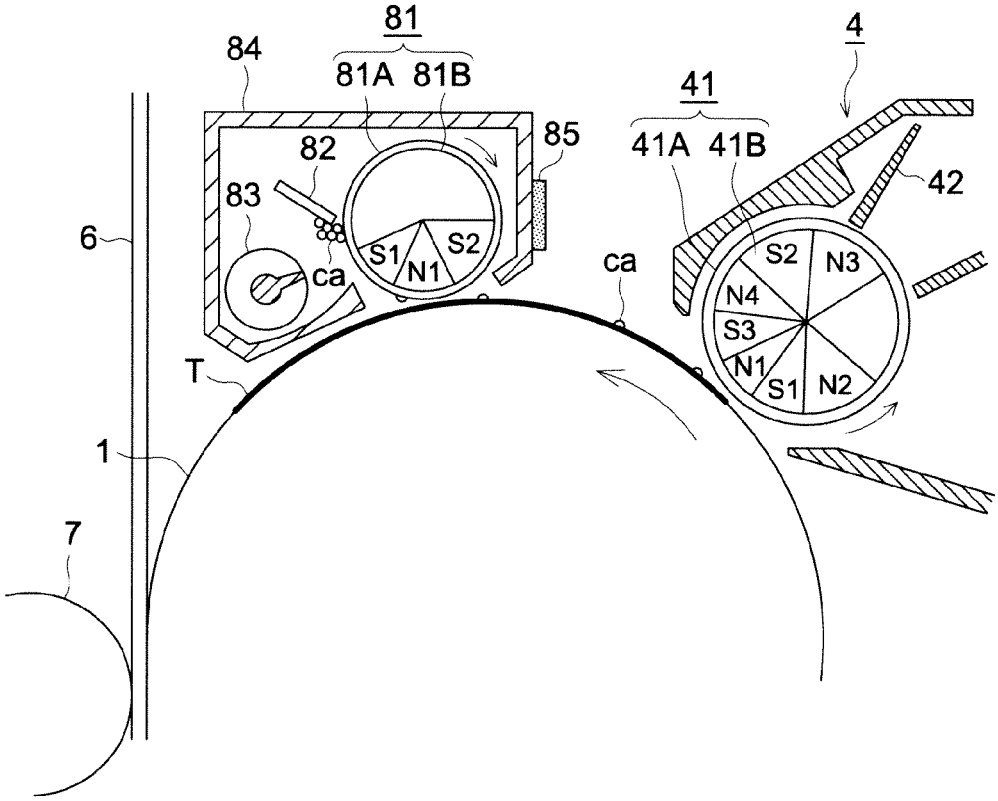
FIG. 6 is a cross-sectional diagram of carrier recovery section 8 according to a second embodiment of the present invention.
Figure 7:
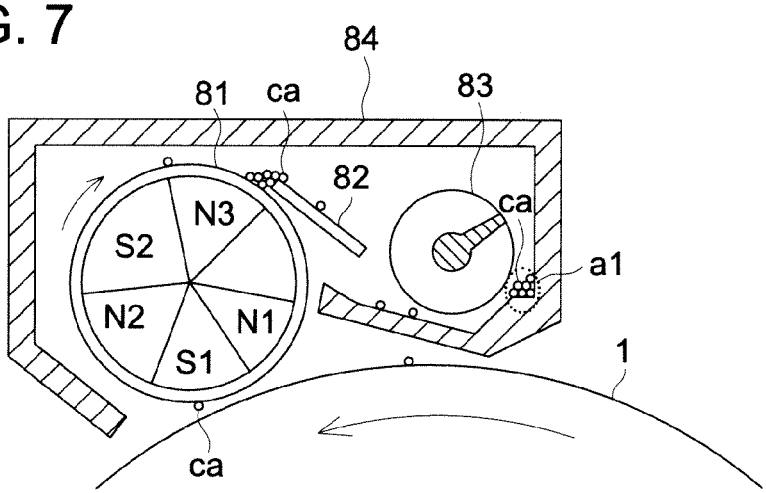
FIG. 7 is a cross-sectional diagram of carrier recovery section 8 according to a third embodiment of the present invention.
Figure 8:
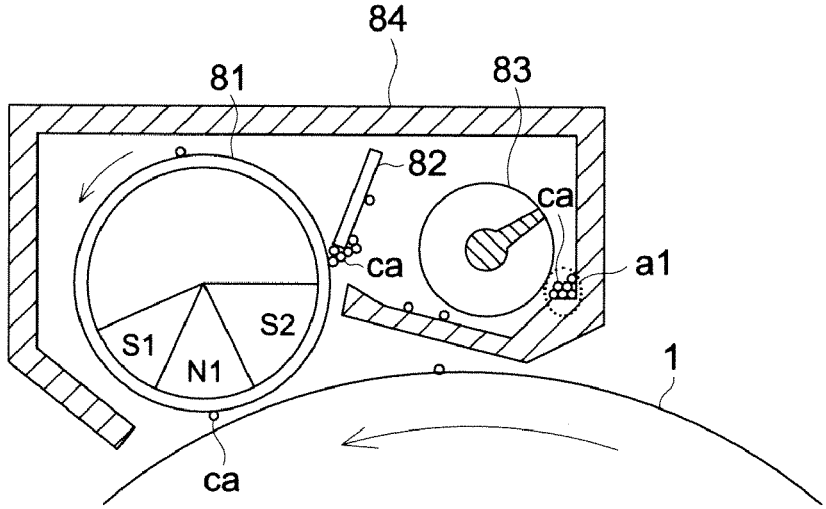
FIG. 8 is a cross-sectional diagram of carrier recovery section 8 according to a fourth embodiment of the present invention.

FIGS. 6, 7, and 8 are each a cross-sectional diagram of carrier recovery section 8 according to a second, a third, and a fourth embodiment of the present invention, respectively. Configurations, other than these shown in the figures, are the same of these of the first embodiment. Also, explanations of component members, which are the same of these used in the first embodiment, are omitted by assigning the same reference symbols.

In this second embodiment, magnetic member 85 is disposed between developing roller 41 and recovery roller 81. It is preferable that magnetic member 85 be disposed in recovery section 8 in term of ease of arrangement, but is not limited to that configuration. In FIG. 6, magnetic member 85 is adhered to chassis 84 by an adhesive agent. Magnetic member 85 is a plate-like tabular member, extending in the direction of rotational axis and the length of magnetic member 85 is at least that of developing roller 81. Also, both ends of magnetic member 85, in the direction of rotational axis, are located in the same positions of those of developing roller 41, or located outside the positions of those of developing roller 41. In this second embodiment, magnet roller 81B, which is installed inside recovery roller 81, consists of three magnetic poles (S1, N1, and S2). The magnetic pole, which is opposite to photoconductor 1 and recovers magnetic carrier "ca" from photoconductor 1, is main pole N1, and magnetic pole which separates magnetic carrier "ca" from recovery roller 81 is separating pole S1. Sleeve 81A rotates clockwise as shown in FIG. 6.

There are always demands for downsizing in the field of image forming apparatus. Specifically, in the case of image forming apparatus 100, which is a tandem method color image forming apparatus being equipped with a plurality of image forming devices 10 (10Y, 10M, 10C, and 10K) as shown in FIG. 1, it is preferable that each of image forming devices 10 be downsized.

In order to reduce the amount of magnetic carrier "ca" adhered onto photoconductor 1, a magnet which is highly magnetized is used for developing roller 41, and thereby, the magnet has a wide-reaching magnetic influence. By the magnet used for developing roller 41, the magnetic fields of the main pole and separating pole of magnet roller 81B are disturbed. On the other hand, magnet roller 81B, which is installed inside recovery roller 81, may influence the magnetic field of developing roller 41. A second problem to be solved by the present invention is to realize downsizing of image forming apparatus as a whole by providing more flexible design of the arrangement of carrier recovery section 8.

Depending on the distance between developing roller 41 and recovery roller 81, the magnetic influence varies, and thereby, the influence can be decreased by increasing the distance. However, an increase in distance has limitations to achieve downsizing of the apparatus, and it is preferable not to have that limitations in the view of design freedom. In this second embodiment shown in FIG. 6, because magnetic member 85 is arranged between developing roller 41 and recovery roller 81, the magnetic field formed by developing roller 41 is short-circuited by magnet member 85, and recovery roller 81 is not influenced by the magnetic field. Conversely, developing roller 41 is not influenced by the magnetic field formed by recovery roller 81 because the magnetic field is also short-circuited by magnetic member 85.

In this embodiment, by arranging magnet member 85 between developing roller 41 and recovery roller 81, the arrangement of carrier recovery section can be freely designed, resulting in downsizing of image forming apparatus as a whole.

Next, the third and fourth embodiments will now be described according to FIGS. 7 and 8. Storage space "a1" is provided inside chassis 84 of carrier recovery section 8 to store magnetic carrier "ca" which is recovered. In the third and fourth embodiments, the magnetic carrier stored in storage space "a1" serves the same function of magnetic member 85 in the second embodiment. In the third embodiment shown in FIG. 7, recovery roller 81 is configured to rotate clockwise, similar to the recovery roller shown in FIG. 3. In the fourth embodiment shown in FIG. 8, on the other hand, recovery roller is configured to rotate counterclockwise. Separating member 82, in this fourth embodiment, is arranged to face the opposite direction of the rotational direction of recovery roller 81 similar to the separating member in the third embodiment, but the number of magnetic poles in this fourth embodiment is different from the third embodiment. Configurations other than these different configurations are the same in both third and fourth embodiments.

Both conveyance screw 83 and its neighboring storage space "a1" are arranged between developing roller 41 and recovery roller 81. The same as magnetic member 85, storage space "a1" extends along the direction of rotational axis and the length is the same as that of developing roller 41 or longer. Storage space "a1" is provided in an inside corner, near developing roller 41, of chassis 84, and magnetic carrier "ca", being attracted by the magnetic field generated by developing roller 41, is stored in the storage space.

Furthermore, because the storage space is arranged close to conveyance screw 83, the amount of stored magnetic carrier can be averaged in the direction of rotational axis. Specifically, magnetic carrier "ca" which is over-spilled from storage space "a1", is conveyed downstream in the conveyance direction (the direction of rotational axis) by conveyance screw 83 which rotates counterclockwise, and conveyed to the area, in storage space "a1", where few magnetic carrier "ca" are stored.

In each of the embodiments shown in FIGS. 7 and 8, storage space "a1" is provided at the inside corner of chassis 84, but is not limited to the configuration. The function of the storage space can be attained, for example, by providing a lateral groove beside conveyance screw 83. Also, the storage space can be provided near recovery roller 81, namely, on the left side of the conveyance screw, different from the configurations in FIGS. 7 and 8 in which storage space is located a little far from recovery roller 81, namely, on the right side of the conveyance screw. In case the storage space is provided on the left side of conveyance screw 83, namely, near recovery roller 81, it is preferable that the rotational direction of conveyance screw 83 be clockwise in order to convey magnetic carrier "ca", beneath conveyance screw 83, properly.

Magnetic carrier "ca" recovered from recovery roller 81 is stored in storage space "a1". The magnetic field formed by developing roller 41 is short-circuited by the stored magnetic carrier "ca", as the same function of previously described magnetic member 85, and thereby, recovery roller 81 is not influenced by the magnetic field. Conversely, developing roller 41 is not influenced by the magnetic field formed by recovery roller 81 because the magnetic field is also short-circuited by the retained magnetic carrier "ca".

[Particular Implementations and Comparison Examples]

Figure 9:
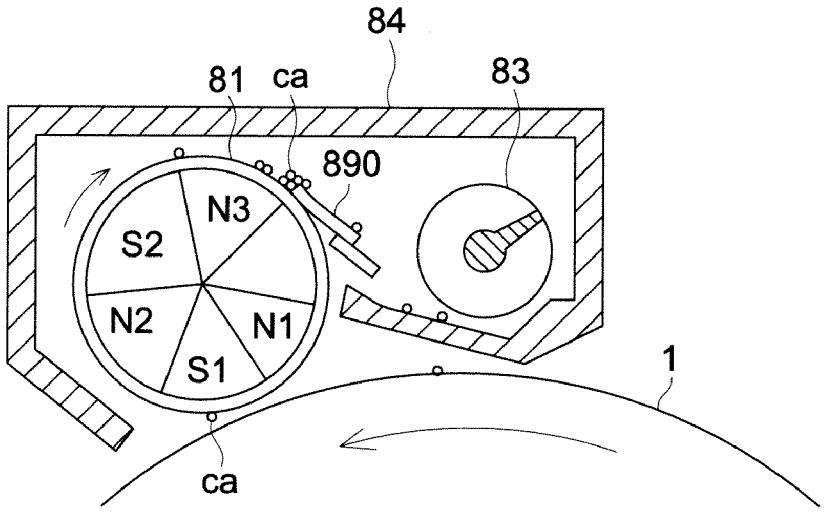
FIG. 9 is a cross-sectional diagram of carrier recovery section 8 of a comparison example.

Performance evaluation tests were carried out for particular implementations No. 1, No. 2, and No. 3, and two comparison examples. The configurations of particular implementations No. 1, No. 2, and No. 3 are shown in FIGS. 6, 7, and 8, respectively. The configuration of comparison example No. 1, in which the separation of magnetic carrier "ca" from recovery roller is carried out by abutting a rubber blade to recovery roller 81 in the opposite direction of the rotational direction of the recover roller, is shown in FIG. 9 which will be described below. The configuration of comparison example No. 2 is that recovery roller 81 is detached from carrier recovery section 8.

[Common Conditions]

(Recovery Roller 81)

External diameter: ϕ18 mm

Surface: Material=Aluminum, Surface roughness Rz=1.0 μmm

Magnetic flux density Br on the surface of sleeve 81A: 120 mT (main pole S1), 50 mT (separating pole N3)

Distance between photoconductor 1 and sleeve 81A: 0.3 mm

Applied electrical voltage to sleeve 81A: Vdc=−700 V, Vac=1100 V, Frequency=2.5 kHz, Duty=60%

The reference mark Vdc denotes the potential of a direct-current component of developing bias.

(Separating Member 82 (Particular Implementations No. 1, No. 2 and No. 3)

Dimensions: Thickness=1.0 mm, Length=330 mm, Width=10 mm (5 mm for only particular implementation No. 2)

Distance between sleeve 81A and separating member 82: 0.2 mm (Conveyance Screw 83)

Material: Nonmagnetic SUS (Stainless Used Steel)

Dimensions: External diameter=ϕ10 mm, Shaft diameter=ϕ6 mm, Screw pitch=10 mm

Direction of rotation: Counterclockwise (Photoconductor 1)

Speed of rotation (liner speed of surface): 500 mm/second

External diameter: ϕ80 mm

Electrical potential of background Vo: −500 V

Electrical potential of exposed area Vi: −50 V
(Developing Roller 41)
Speed of rotation: 900 mm/second
Dimension: External diameter=ϕ30 mm
Applied electrical voltage to sleeve 41B: Vdc=−300 V, Vac=1000 V, Frequency=9.0 kHz, Duty=50%
Center position of developing roller 41 (angle): 45° (45 degrees)
The above described angle is the angle between the line connecting the centers, of developing roller 41 and photoconductor 1, and horizontal line)
(Developer)
Average particle diameter of toner: 6.5 μm
Average particle diameter of magnetic carrier "ca": 30 μm
Relative magnetic permeability of magnetic carrier "ca": 3.5
Toner density (mass ratio): 7%
Developer amount: 1000 g
(Others)
Conditions, other than these common conditions described in the above and individual conditions to be described bellow, are the same of these used in the embodiments described in FIGS. 1 and 2. Individual conditions will be now described.
[Particular Implementation No. 1 (FIG. 6)]
(Separating Member 82)
Material: Magnetic SUS (Stainless Used Steel)
(Magnetic Member 85)
Material: Magnetic SUS (Stainless Used Steel)
Dimensions: Length=330 mm, Width=4 mm
Position: Vertically adhered to the lateral surface of chassis 84, and the angle, between the line connecting the lower end of magnetic member 85 and center of photoconductor 1 and horizontal line, is 80° (80 degrees).
(Others)
Speed of rotation of recovery roller 81 (Liner speed of surface): 450 mm/second Direction of rotation of recovery roller 81: Clockwise
Magnet roller 81B: 3 poles (Main pole N1, Separating pole S1)
Center position (angle) of recovery roller 81: 95° (95 degrees)
(The above described angle is the angle between the line connecting the centers, of recovery roller 81 and photoconductor 1, and horizontal line)
Position of arrangement of separating member 82: End "ed" is positioned at 25° (25 degrees) downstream of the center position of separating pole S1 in the rotational direction.
[Particular Implementation No. 2 (FIG. 7)]
(Separating Member 82)
Material: Magnetic SUS (Stainless Used Steel)
(Others)
Speed of rotation of recovery roller 81 (liner speed of surface): 450 mm/second
Direction of rotation of recovery roller 81: Clockwise
Magnet roller 81B: 5 poles (Main pole N1, Separating pole N3)
Center position of recovery roller 81 (angle): 115° (115 degrees)
(The above described angle is the angle between the line connecting the centers, of recovery roller 81 and photoconductor 1, and horizontal line)
Position of arrangement of separating member 82: End "ed" is positioned at 10° (10 degrees) downstream of the center position of separating pole N3 in the rotational direction.
[Particular Implementation No. 3 (FIG. 8)]
(Separating Member 82)
Material: Nonmagnetic SUS (Stainless Used Steel)
(Others)
Speed of rotation of recovery roller 81 (liner speed of surface): 500 mm/second
Direction of rotation of recovery roller 81: Counterclockwise
Center position of magnet roller 81B (angle): 115° (115 degrees)
(The above described angle is the angle between the line connecting the centers, of recovery roller 81 and photoconductor 1, and horizontal line)
Position of arrangement of separating member 82: End "ed" is positioned at 28° (28 degrees) downstream of the center position of separating pole S2 in the rotational direction.
[Comparison Sample No. 1 (FIG. 9)]
Speed of rotation of recovery roller 81 (liner speed of surface): 450 mm/second
(Rubber Blade 890)
Material: Urethane rubber
Dimensions: Thickness=1 mm, Length=330 mm, Width=5 mm
Abutment angle to roller 81: 20° (20 degrees) in the opposite direction of rotational direction of recover roller 81.
[Comparison Sample No. 2 (Carrier Recovery Section 8 does not Function)]
Recovery roller 81 is detached from carrier recovery section 8.
[Common Experimental Conditions and Evaluation Indexes]
Paper sheet=A4 size, Print ratio=5%, Print mode=Continuous printing.
The fogging margin is set as 200 V (=|Vo−Vdc|) as previously described in common conditions for recovery roller 81 and photoconductor 1.
Note: The |Vo−Vdc| is a potential range in which the toner does not adhere, and is called the fogging margin.

The amount of magnetic carriers "ca" adhered onto photoconductor 1 was evaluated. Sampling of the amount of adhered carriers was carried out, by shutting down the image forming apparatus suddenly during image forming, and by collecting magnetic carrier "ca" by an adhesive tape, of the sizes of length of 297 mm and width of 18 mm, from the surface of photoconductor 1 at the location downstream of recovery roller 81 and upstream of primary transfer roller 7, and by counting the number of magnetic carriers "ca" being adhered on the surface of the adhesive tape. Samplings were carried out several times and the average number of adhered number of magnetic carriers "ca" was used. As an evaluation index, it can be judged "Good" if the average number is 5 or less.

TABLE 1

| | Number of prints | | |
|---|---|---|---|
| | 5,000 | 10,000 | 15,000 |
| Particular implementation No. 1 | 3 | 4 | 4 |
| Particular implementation No. 2 | 0 | 2 | 0 |
| Particular implementation No. 3 | 0 | 2 | 0 |
| Comparison example No. 1 | 0 | 4 | 14 |
| Comparison example No. 2 | 13 | 15 | 12 |

TABLE 1 shows the result of evaluations. As shown in the TABLE 1, in the cases of particular implementations No. 1, No. 2, and No. 3 in which separating member 82 was arranged, the level of adhered magnetic carrier was "Good". On the other hand, in the case of comparison example No. 2 in which neither separating member 82 nor rubber blade 890 was arranged, the level of adhered magnetic carrier was worst.

In the case of comparison example No. 1, the level of adhered magnetic carrier was "Good" in early stage, but the level was deteriorated as the number of prints increases. On the other hand, the deterioration was not observed in the cases of particular implementations No. 1, No. 2, and No. 3.

The reason that the level of adhered magnetic carrier "ca" was deteriorated in comparison example No. 1, is that an insulating layer was generated due to the adherence of toner onto the surface of recovery roller 81, and electric field between recovery roller 81 and photoconductor 1 was altered by the insulating layer of adhered toner, resulting in degradation of carrier recovery performance. The reason that the toner adhered onto the surface of recovery roller 81, is that the toner being adhered on to the magnetic carrier was melted and adhered onto the surface due to the heat and pressure generated by continuous sliding at the point of contact of rubber blade 890 and the surface of recovery roller 81.

Next a fifth embodiment of the present invention will be described. The structure of the image forming apparatus shown in FIG. 1 of the previously described embodiments is the same as the structure described in the fifth embodiment, thus the descriptions are omitted. In this embodiment, a magnetic member is used for separating member 82. An advantage of using a magnetic member for separating member 82 is as follows. A wall of magnetic lines of force (flux) between separating pole N3 and separating member 81, being composed of a magnetic member, is formed. Then, a magnetic brush is formed by magnetic carrier "ca" being retained on the wall of magnetic lines. Because of the magnetic brush, magnetic carrier "ca" which is not influenced of magnetic force will be separated from the magnetic brush and also separated from roller 81. Also, the surface of separating member 82, which is not opposite to recovery roller 81, is an inclined surface extending in the direction toward downward (with edge, near the recovery roller, being at the upper end of separating member 82), and separated magnetic carrier "Ca" will slides freely along the inclined surface.

Carrier recovery section 8 will now be described with reference to FIG. 10. Carrier recovery section 8 includes recovery roller 81, separating member 82, and conveyance screw 83. Carrier ca which is adhered onto photoconductor 1 together with toner image T, which has been developed in developing section 4, is recovered by carrier recovery section 8. Recovery roller 81 is disposed in a space relationship at a prescribed distance from photoconductor 1 and consists of sleeve 81A of which the outer surface is rotatable and fixed magnetic pole (magnetic roller) 81B which is installed into inner space of developing sleeve 81A. The direction of rotation of sleeve 81A (hereinafter, simply called as "the direction of rotation") is clockwise as shown in FIG. 10.

Figure 10:
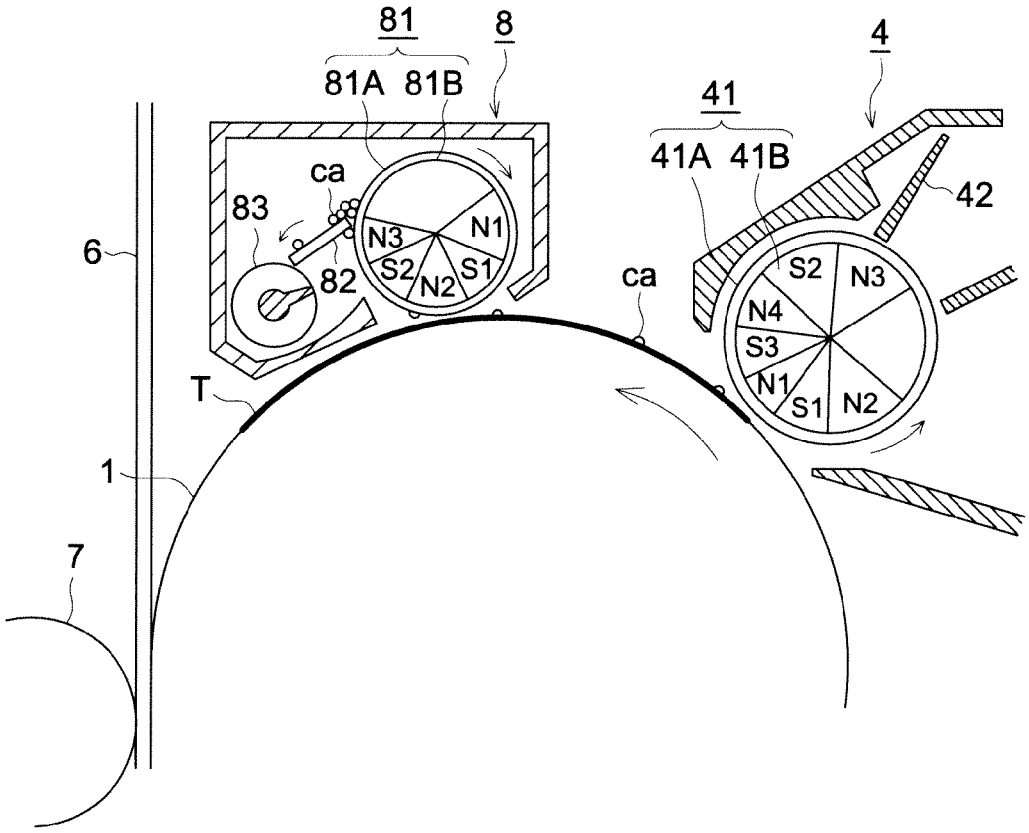
FIG. 10 is an enlarged cross-sectional diagram of carrier recovery section 8 and the circumstances thereof according to a fifth embodiment of the present invention.

In the fifth embodiment shown in FIG. 10, magnet roller 81B is placed inside of recovery sleeve 81A and a plurality of magnetic poles (N1, S1, N2, S2, and N3) is fixedly accommodated in magnet roller 81B. In the example shown in FIG. 10, magnetic pole opposing to photoconductor 1 is main pole N2 and the magnetic carrier adhered onto photoconductor 1 is recovered from photoconductor 1 by main pole N2. Downstream of N2 in the direction of rotation, separation pole N3 is placed after magnetic pole S2. Separating member 82 is disposed at such a position that opposes to recovery roller 81 within magnetic field generated by separation pole N3. Magnetic carrier "ca" recovered from photoconductor 1 by main pole N2 is separated (repelled) by pole N3, and is retained in the magnetic field formed between separating member 82, which is composed of a magnetic member, and separating pole N3. A part of retained magnetic carrier "ca" drops downward and is conveyed axially by conveyance screw 83 and, successively, conveyed toward a discharge box (not shown in the drawings) located downstream of conveyance screw 83.

Separating member 82 is disposed in a space relationship at a prescribed distance from recovery roller 81 (sleeve 81A) in a non-contact state. Even in the non-contact state, it is possible to prevent magnetic carrier "ca", which is retained in the space between separating member 82 and separation pole N3, from adhering again to recovery roller 81 and being conveyed downstream by arranging separating member 82 under certain conditions.

Figure 11A:
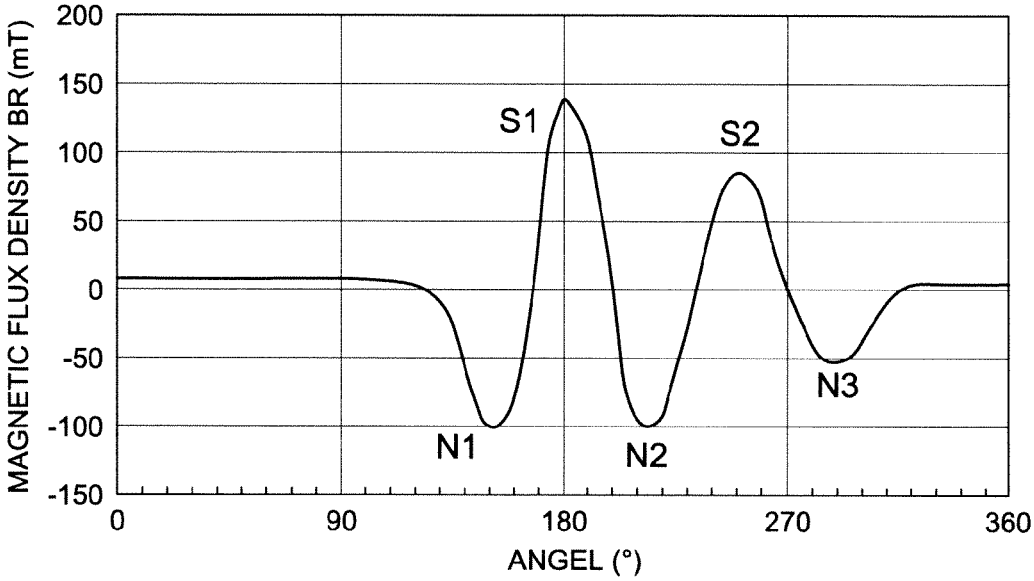
FIGS. 11*a* and 11*b* are each a view showing the distribution of magnetic flux density Br in the normal direction on the surface of recovery roller 81 according to the fifth embodiment of the present invention.
Figure 11B:
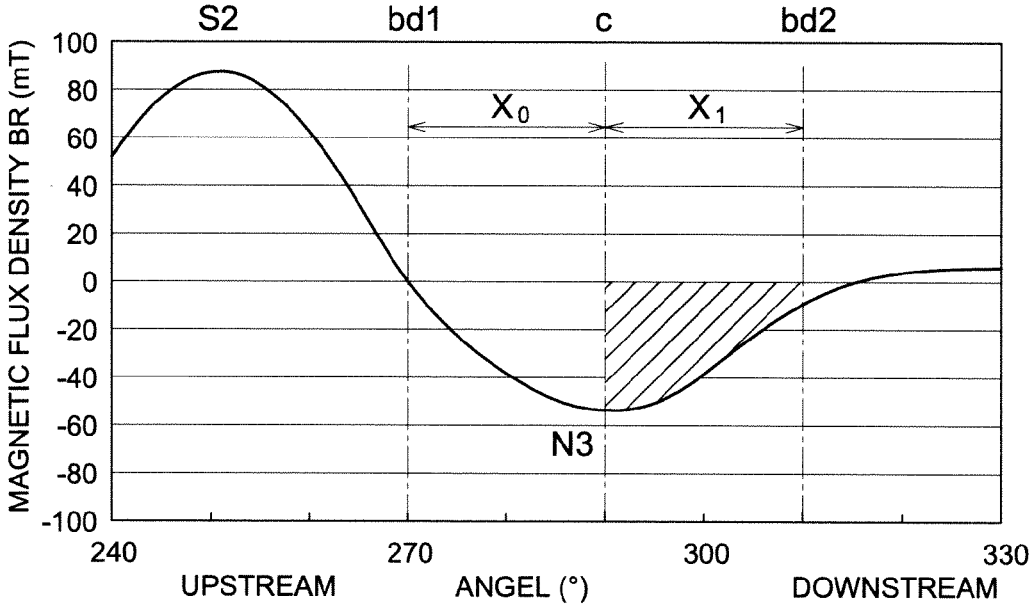

FIGS. 11*a* and 11*b* are each a view showing the distribution of magnetic flux density Br in the normal direction on the surface of recovery roller 81 according to the fifth embodiment. FIG. 11*a* is a view showing the distribution of magnetic flux density Br of entire periphery of recovery roller 81. FIG. 11*b* is an enlarged view showing the distribution of magnetic flux density Br of the periphery of separation pole N3. An abscissa axis represents angle (°), and an ordinate axis represents magnetic flux density Br (mT). In FIG. 11*b*, "c" is the peak position of separation pole N3. As a definition of the peak position, for example, the center position of half-value width of the peak value of magnetic flux density Br, or the center position of 80% value width of magnetic flux density Br can be used. Reference symbol "bd1" is a boundary position upstream in the direction of rotation. Reference symbol "bd2" is a boundary position downstream in the direction of rotation, and in this embodiment, boundary position "bd2" is set at position X1° apart downstream from peak position "c". Here, X1 and X0 is the same and X0 is the angle between boundary position "bd1" and peak position "c".

In the present invention, the description of "in the magnetic field generated by separation pole N3" means "the area between boundary positions "bd1" and "bd2" in the case of the rotational direction θ of sleeve 81A, and in the case of the radial direction "r" of sleeve 81A, the magnetic field is within a few mm from the surface of sleeve 81A".

The description of "the area downstream of the peak position of magnetic flux density Br in the direction of rotation of the sleeve" means "the area which includes peak position "c" in the rotational direction θ of sleeve 81A, and downstream of peak position "c" and upstream of boundary position "bd2" (A hatched area in FIG. 11*b*).

[Position of Arrangement of the Edge of Separating Member 82]

FIGS. 12*a* through 12*f* are each a view showing a positional relationship between separating member 82 and recovery roller 81 according to the fifth embodiment of the present invention. With reference to drawings, the position of arrangement of separating member 82 will be now described. Separating member 82 consists of at least one edge. Here, edge means angle (corner) with a cutting surface in the cutting direction vertical to the axis of rotation of sleeve 81A. Also, it is preferable that the radius of curvature R of the edge of the separating member be 0.5 mm or less (as will hereinafter be described in detail).

In the drawings, separating member 82 is a quadrangular columnar of which cross-sectional shape is a rectangular shape. Each of two edges of the member is disposed in the magnetic field of separation pole N3. In this embodiment, one of the edges located upstream of the direction of rotation of sleeve 81 is denoted by reference symbol "eg", and the other edge (any edges else, edges other than edge "eg") is denoted by reference symbol "eo".

Examples shown in FIGS. 12*a* through 12*f* all satisfy conditions for the position of arrangement according to the fifth embodiment of the present invention. In the case of examples shown in FIGS. 12*a*, 12*b* and 12*c*, edge "eg" downstream is disposed within the magnetic filed generated by separation pole N3 (herein after, called "condition 1"), and is disposed downstream side of peak position "c" of magnetic flux density Br in the direction of rotation of sleeve 81 (hereinafter, called "condition 2"). In the case of examples shown in FIGS. 12*d*, 12*e* and 12*f*, both edge "eg" and edge "eo" are disposed within the magnetic filed generated by separation pole N3 and disposed downstream side of peak position "c" of magnetic flux density Br in the direction of rotation of sleeve 81.

Figure 13A:
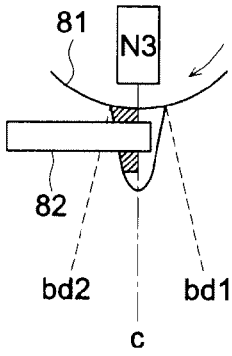
FIGS. 13*a* to 13*f* are each a view explaining a positional relationship between separating member 82 and recovery roller 81 in a comparison example which does not fulfill the conditions of a position of arrangement according to the fifth embodiment of the present invention.
Figure 13B:
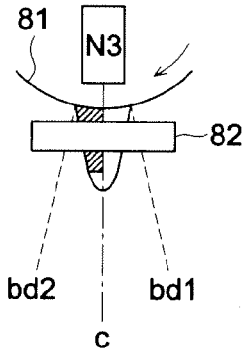
Figure 13C:
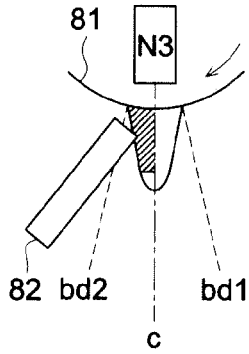
Figure 13D:
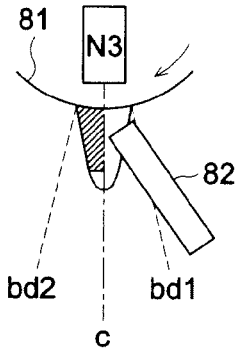
Figure 13E:
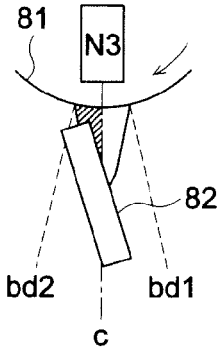
Figure 13F:
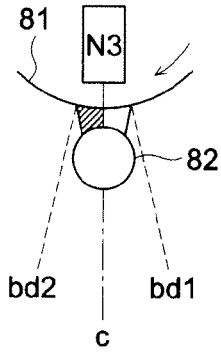

FIGS. 13*a* though 13*f* are each a view explaining a positional relationship, between separating member 82 and recovery roller 81, of comparison examples which do not fulfill the conditions of the position of arrangement according to the fifth embodiment of the present invention. In the cases of FIGS. 13*a* and 13*d*, the positions of edge "eg" do not fulfill condition 2. In the cases of FIGS. 13*b*, 13*c*, and 13*e*, the positions of edge "eg" do not fulfill both conditions 1 and 2. In the case of FIG. 13*f*, neither conditions 1 nor 2 is fulfilled because separating member 82 is configured of no edge due to column-shaped cross-section.

Figure 14A:
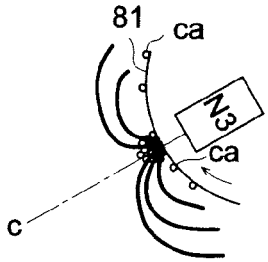
FIGS. 14*a* and 14*b* are each a schematic view showing the distribution of the lines of magnetic force around separating pole N3 according to the fifth embodiment of the present invention.
Figure 14B:
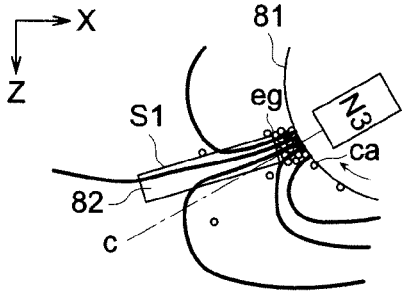

FIGS. 14*a* and 14*b* are each a schematic view showing the distribution of magnetic flux density around separating pole N3 according to the fifth embodiment of the present invention. As shown in FIG. 14*a*, in the state in which separating member 82 is not arranged, the lines of magnetic force from separating pole N3 directing upstream and downstream in the direction of rotation of sleeve 81A, are formed. On the other hand, in the state in which separating member 82, being composed of a magnetic member, is arranged as shown in FIG. 14*b*, because the lines of magnetic force from separating pole N3 pass through separating member 82 and direct upstream and downstream, the lines of magnetic force directing downstream can be eliminated near edge "eg" of separating member 82.

Magnetic carrier "ca", recovered from photoconductor 1 by main pole N2, retains in the magnetic field generated by separating pole N3 and separating member 82. As retained magnetic carrier "ca" increases, magnetic carrier "ca" which cannot retain in the magnetic field is pushed out downstream. In the configuration shown in FIG. 14*b*, there is no line of magnetic force directing downstream on the periphery of edge "eg" of separating member 82, and thereby, there is no magnetic force directing downstream. Therefore, the magnetic carrier which has been pushed out downstream, moves along inclined surface S1 of separating member 82, not toward downstream in the direction of rotation of sleeve 81A.

Inclined surface S1 is the surface which abuts to edge "eg", and is the surface which is not opposite to recovery roller 81. In FIG. 14*b*, arrow Z shows the vertical direction and arrow X shows the horizontal direction. In the case of the configuration shown in FIG. 14*b*, inclined surface 51 is the inclined surface which directs downward with edge "eg" at the top of the slope. As the surface is downwardly-inclined, the magnetic carrier, having been pushed out, slides downward along inclined surface S1 by gravity.

It is preferable that inclined surface incline downward with edge "eg" at the top of the slope, but is not limited to the configuration. Inclines surface S1 can be a surface which is horizontal or inclines upward. In these cases in which surface S1 is horizontal or inclines upward, the magnetic carrier, having been pushed out, falls downward in vertical direction from upstream.

[Distribution of the Lines of Magnetic Force]

Figure 20:
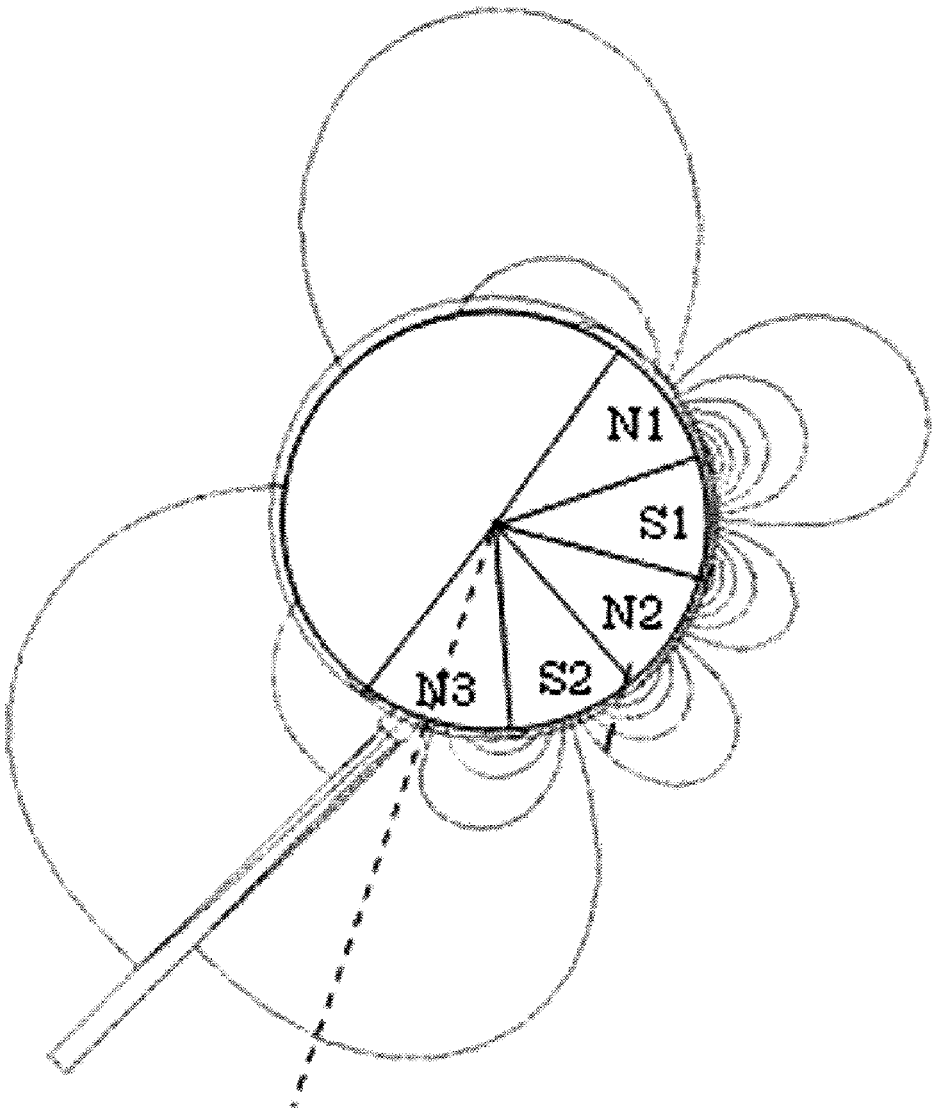
FIG. 20 is a schematic view showing a pattern of the distribution of the lines of magnetic force around recovery roller 81 when separating plate 82 is disposed near separating pole N3.
Figure 21:
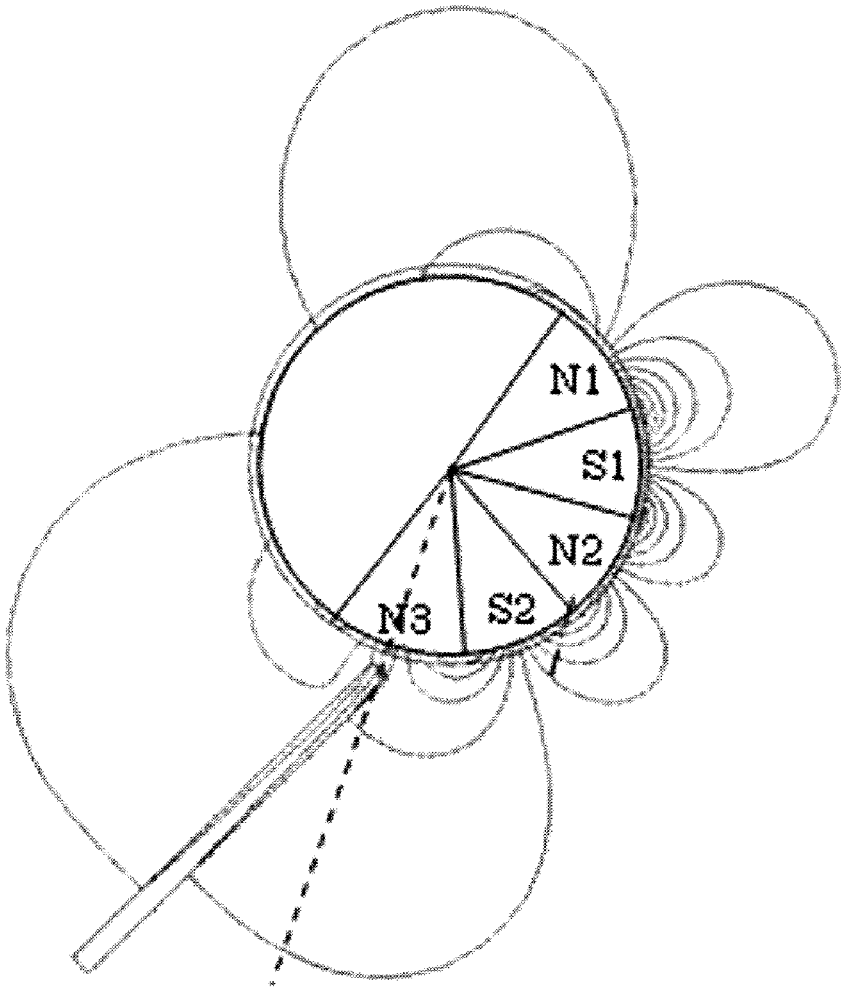
FIG. 21 is a schematic view showing a pattern of the distribution of the lines of magnetic force around recovery roller 81 when separating plate 82 is disposed near separating pole N3.
Figure 22:
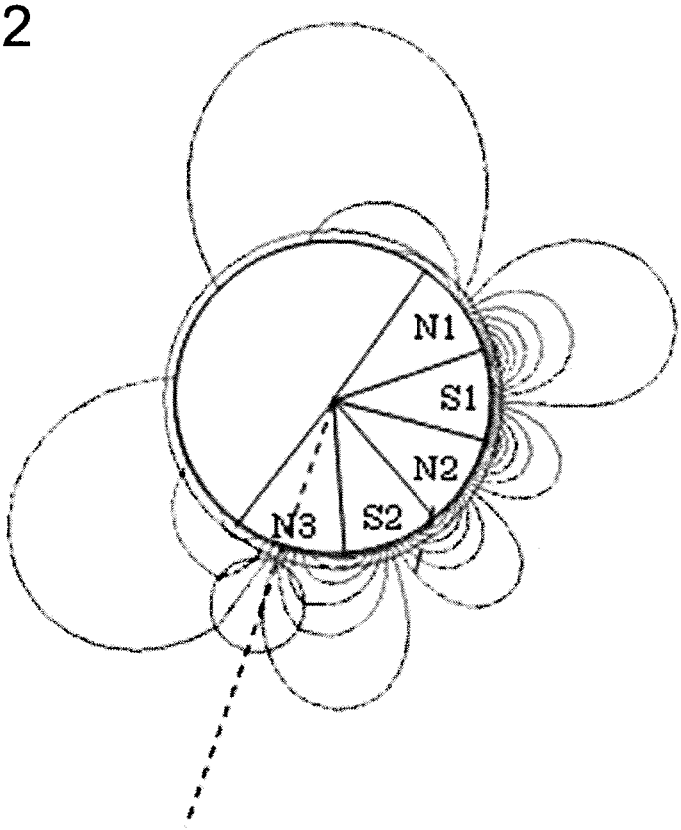
FIG. 22 is a schematic view showing a pattern of the distribution of the lines of magnetic force around recovery roller 81 when separating plate 82 is disposed near separating pole N3.

FIGS. 15 through 23 are each a schematic view showing a pattern of the distribution of the lines of magnetic force around recovery roller 81 in the cases in which separating plate 82 is disposed near separating pole N3. These figures are the results of analysis using magnetic field analysis software (ANSYS version 11.0 SP1 (CYBERNET SYSTEMS CO., LTD)). In TABLE 2, FIGS. 15, 18, 21, and 23 are particular implementations of the fifth embodiment, and FIGS. 16, 17, 19, 20, and 22 are comparison examples. Conditions for the particular implementations and comparison examples are shown in TABLE 2. FIG. 22 shows a case of a configuration in which separating member 82 consists of no edge, and in the column of edge position for FIG. 22 in TABLE 2, information on edge position of section, that is closest to sleeve 81A, is described by angular difference between the closest section and the center position of separating pole N3 in normal direction.

TABLE 2

Figure 15:
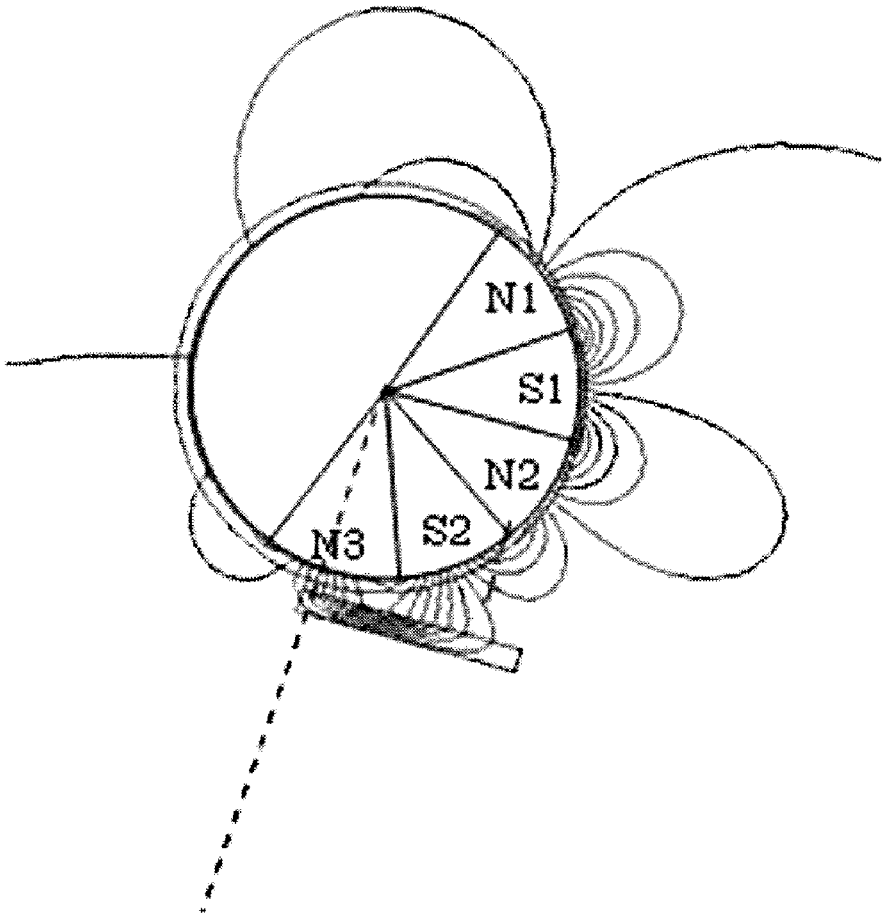
FIG. 15 is a schematic view showing a pattern of the distribution of the lines of magnetic force around recovery roller 81 when separating plate 82 is disposed near separating pole N3.
Figure 16:
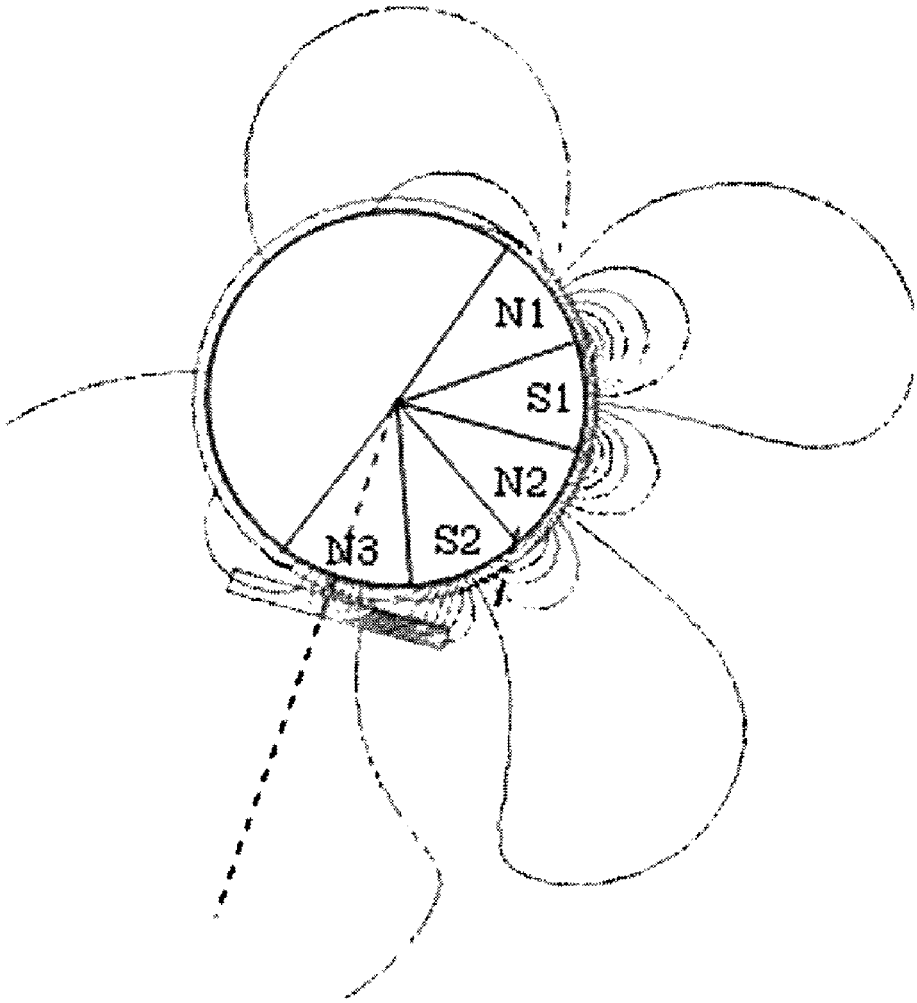
FIG. 16 is a schematic view showing a pattern of the distribution of the lines of magnetic force around recovery roller 81 when separating plate 82 is disposed near separating pole N3.
Figure 17:
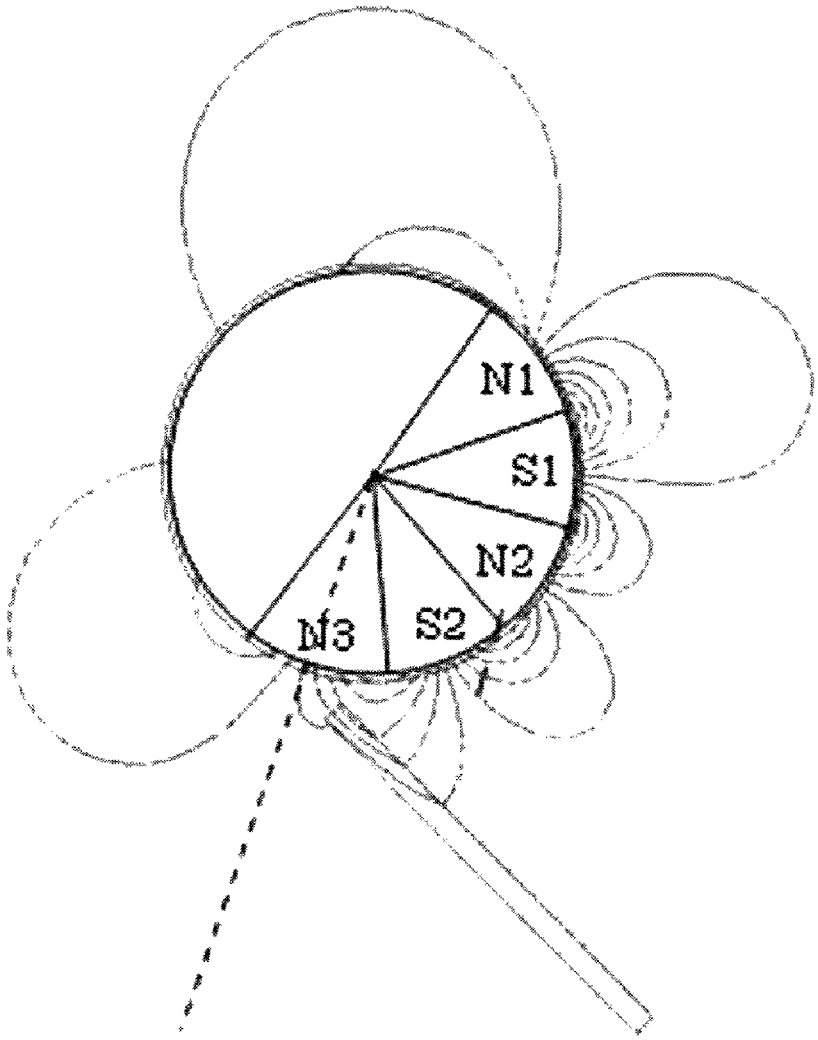
FIG. 17 is a schematic view showing a pattern of the distribution of the lines of magnetic force around recovery roller 81 when separating plate 82 is disposed near separating pole N3.
Figure 18:
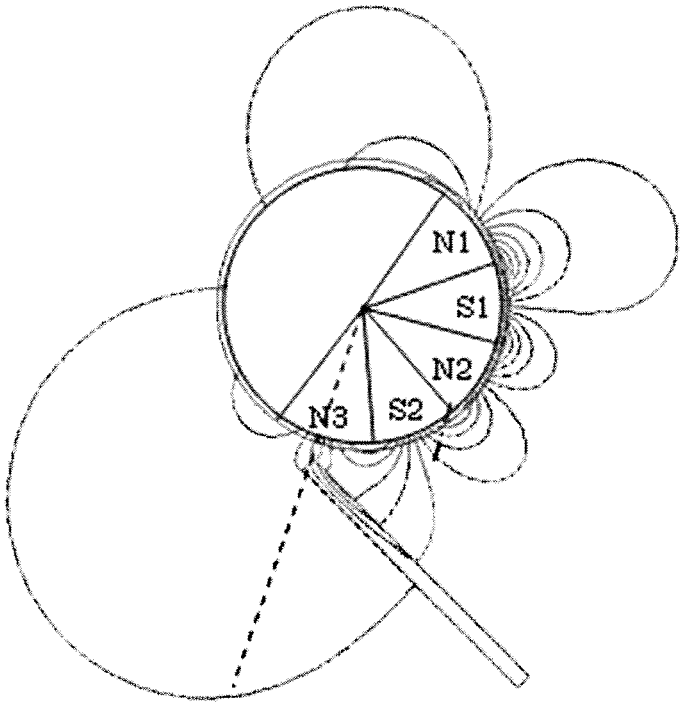
FIG. 18 is a schematic view showing a pattern of the distribution of the lines of magnetic force around recovery roller 81 when separating plate 82 is disposed near separating pole N3.
Figure 19:
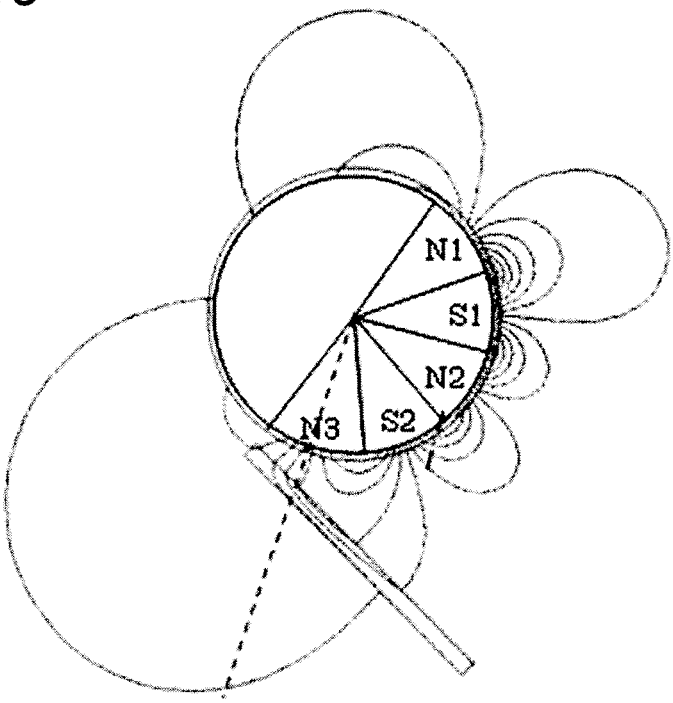
FIG. 19 is a schematic view showing a pattern of the distribution of the lines of magnetic force around recovery roller 81 when separating plate 82 is disposed near separating pole N3.
Figure 23:
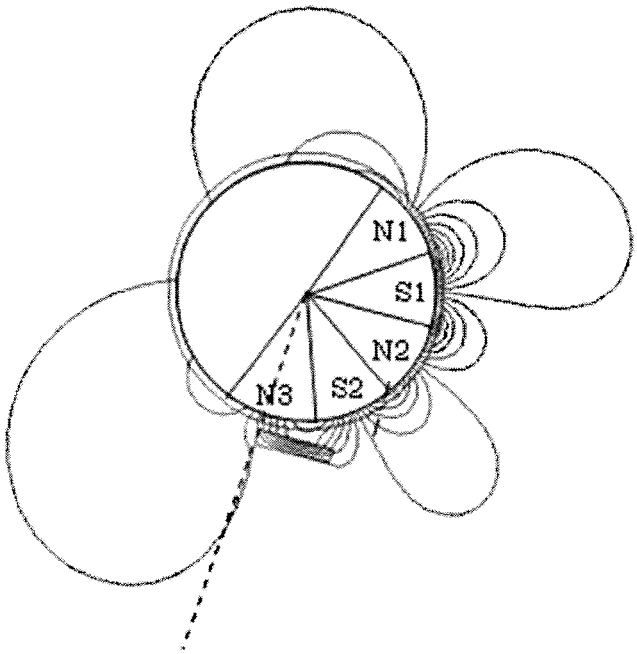
FIG. 23 is a schematic view showing a pattern of the distribution of the lines of magnetic force around recovery roller 81 when separating plate 82 is disposed near separating pole N3.

| | Cross-sectional shape of separating member (short side, long side) | Distance from sleeve 81A | Position of edge (relative angle of edge and the center position of separating pole N3) | Inclination angel (relative angle of inclined surface and tangential line at the position of separating pole N3) | |
|---|---|---|---|---|---|
| FIG. 15 | Rectangle (1 mm, 10 mm) | 0.2 mm | 4° | 0° (parallel) | particular implementation |
| FIG. 16 | Rectangle (1 mm, 10 mm) | 0.2 mm | 24° | 0° (parallel) | comparison example |
| FIG. 17 | Rectangle (1 mm, 20 mm) | 0.5 mm | −10° (upstream side) | 27° | comparison example |
| FIG. 18 | Rectangle (1 mm, 20 mm) | 0.5 mm | 0° | 25° | particular implementation |
| FIG. 19 | Rectangle (1 mm, 20 mm) | 0.5 mm | 18° | 30° | comparison example |
| FIG. 20 | Rectangle (1 mm, 10 mm) | 0.4 mm | 11° | 15° | comparison example |
| FIG. 21 | Rectangle (1 mm, 20 mm) | 0.4 mm | 4° | 25° | particular implementation |
| FIG. 22 | Round shape with a diameter of 5 mm | 0.2 mm | 5° | N/A | comparison example |
| FIG. 23 | Rectangle (1 mm, 5 mm) | 0.2 mm | 0° | 0° (parallel) | particular implementation |

FIG. 15 is a schematic view showing a pattern of the distribution of the lines of magnetic force around recovery roller 81 in the case in which the position of arrangement of separating member 82 corresponds to the position of arrangement shown in FIG. 13*a*. Configuration shown in FIG. 15 satisfies both conditions 1 and 2 according to this embodiment of the present invention. Further more, the border between the lines of magnetic force directing downstream from separating pole N3 and the lines directing upstream, passes through the inside of separating member 82 (hereinafter, called condition 3). By satisfying these conditions, it is possible to separate magnetic carrier "ca".

In the case shown in FIG. 16, the position of arrangement does not satisfy conditions 1 and 2, and magnetic carrier "ca" is conveyed downstream. In the case shown in FIG. 17, the position of arrangement does not satisfy conditions 2 and 3, and magnetic carrier "ca" is conveyed downstream. In the case shown in FIG. 18, the position of arrangement satisfies all conditions 1, 2, and 3, and it is possible to separate magnetic carrier "ca". In the case shown in FIG. 19, the position of arrangement does not satisfy conditions 1 and 2, and magnetic carrier "ca" is conveyed downstream. In the case shown in FIG. 20, the position of arrangement corresponds to that shown in FIG. 13*c*. In the case, shown in FIG. 21, the position of arrangement satisfies all conditions 1, 2, and 3, and it is possible to separate magnetic carrier "ca". In the case shown in FIG. 21, the position of arrangement corresponds to that shown in FIG. 13*f*. In the case shown in FIG. 22, the position of arrangement does not satisfy conditions 1 and 2 because no edge exists, and magnetic carrier "ca" is conveyed downstream.

In the case shown in FIG. 23, the position of arrangement satisfies conditions 1 and 2, and therefore, this case fulfills the conditions according to the present invention. However, in this case, the lines of magnetic force directing downstream from separating pole N3 do not pass through the inside of separating member 82, in other words, the boundary between the lines of magnetic force directing downstream and upstream does not pass through the inside of separating member 82, and therefore, does not satisfy condition 3. In the particular implementation shown in FIG. 23, it is possible to separate magnetic carrier "ca" in initial stage. However, in a state in which developer is deteriorated due to a long-term usage of the developer, magnetic carrier "ca" tends to be conveyed downward.

[Particular Implementations Comparison Examples]

Experiments, by particular implementations No. 1 and No. 2 according to this embodiment and by comparison examples No. 1 through No. 4 for the purpose of comparison, were carried out. Comparison example No. 1 is an example in which separating member 82 which is made of a magnetic member, without edge is used, and comparison example No. 2 is an example in which the position of arrangement of the edge of separating member 82 does not satisfy the conditions. Comparison examples No. 3 and No. 4 are examples in which separating member 82 which is made of non-magnetic member is used.

[Common Conditions]

(Recovery Roller 81)

External diameter: ϕ18 mm

Speed of rotation (Liner speed of surface): 450 mm/second

Surface: Material=Aluminum, Surface roughness Rz=10 μm

Magnet roller 81B: 5 poles (arrangement angles are the same as those shown in FIG. 3)

Magnetic flux density Br on the surface of sleeve 81A: 120 mT (main pole N2), 50 mT (separating pole N3)

Distance between photoconductor 1 and sleeve 81A: 0.3 mm (Separating Member 82)

Material: Magnetic SUS (Stainless Used Steel)

Dimension (in the rotational direction of sleeve 81A): Length=330 mm (Magnetic Carrier)

Magnetic carrier: Average particle diameter=30 μm, Relative magnetic permeability=3.5

Initial carrier amount: 0.3 g/cubic centimeter (total amount=9.9 g)

[Conditions for Particular Example No. 1]

Figure 12A:
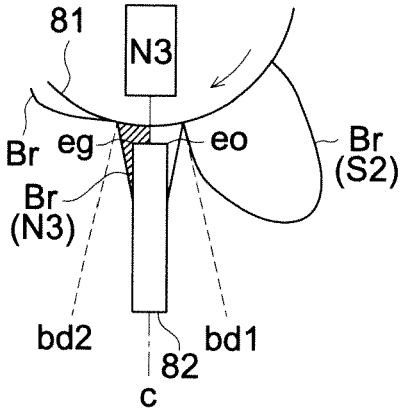
FIGS. 12*a* to 12*f* are each a view showing a positional relationship between separating member 82 and recovery roller 81 according to the fifth embodiment of the present invention.
Figure 12B:
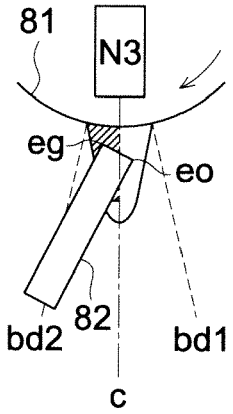
Figure 12C:
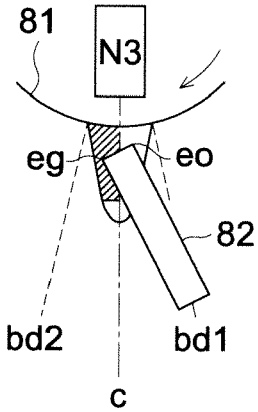
Figure 12D:
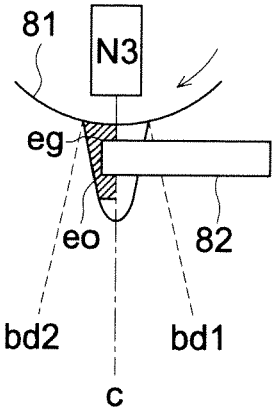
Figure 12E:
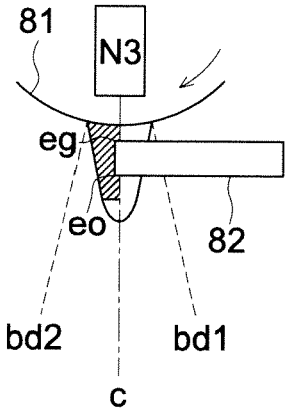
Figure 12F:
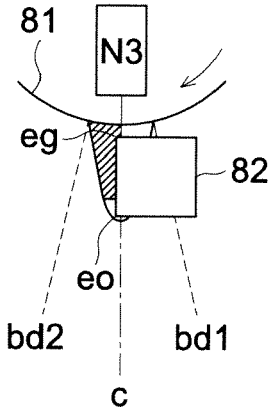

This example corresponds to the previously described FIG. 12*d*.

(Separating Member 82)

Configuration (shape): Rectangular in shape

Dimensions (cross-sectional direction): Short side=2 mm, Long side=10 mm (cross-sectional direction)

Curvature radius of edge "eg": 0.1 mm or less (Relationship of the Position of Arrangement)

Sleeve 81A and separating member 82: Distance (at most proximal section)=0.3 mm. Edge "eg" is positioned at 4° (4 degrees) downstream of the center position of separating pole N3. Long side is positioned parallel to the tangential direction of sleeve 81A at the center position of separating pole N3. Inclination angle of short side (angle against horizontal line) is 1° (1 degree).

[Conditions for Particular Implementation No. 2]

This implementation corresponds to the previously described FIG. 12*b*.

(Separating Member 82)

Configuration (shape): Rectangular in shape

Dimensions (cross-sectional direction): Short side=1 mm, Long side=10 mm Curvature radius of edge "eg": 0.1 mm or less (Relationship of the Position of Arrangement)

Sleeve 81A and separating member 82: Distance (at most proximal section)=0.4 mm. Edge "eg" is positioned at 4° (4 degrees) downstream of the center position of separating pole N3. The angle between short side and tangential line of sleeve 81A at the center position of separating pole N3 is 25° (25 degrees). Inclination angle of long side (angle against horizontal line) is 65° (65 degrees).

[Conditions for Comparison Example No. 1]

This example corresponds to the previously described FIG. 13*f*.

(Separating Member 82)

Configuration (shape): Rectangular in shape

Dimension (cross-sectional direction): ϕ6 mm (Relationship of the Position of Arrangement)

Sleeve 81A and separating member 82: Distance (at most proximal section)=0.2 mm.

[Conditions for Comparison Example No. 2]

This implementation corresponds to the previously described FIG. 13*b*.

(Separating Member 82)

Configuration (shape): Rectangular in shape

Dimensions (cross-sectional direction): Short side=2 mm, Long side=5 mm (cross-sectional direction)

Curvature radius of edge "eg": 0.1 mm or less (Relationship of the Position of Arrangement)

Sleeve 81A and separating member 82: Distance (at most proximal section)=0.3 mm. Edge "eg" is positioned at 14° (14 degrees) downstream of the center position of separating pole N3. Long side is positioned parallel to the tangential direction of sleeve 81A at the center position of separating pole N3. Inclination angle of short side (angle against horizontal line) is 17° (17 degrees).

[Conditions for Comparison Example No. 3]

Conditions for sleeve roller 81 and the magnetic carrier are the same as those for the previously described common conditions for comparison example No. 1.

Separation of magnetic carrier from recovery roller 81 without using separating member 82 was carried out by abutting a scraper which is made of SUS plate to recovery roller 81 at the position of separating pole N3 in the opposite direction to the rotational direction of recovery roller 81.

[Conditions for Comparison Example No. 4]

Conditions for sleeve roller 81 and magnetic carrier are the same as these for the previously described common conditions for comparison example No. 1. Separating member 82 was not used. Separation of magnetic carrier from recovery roller 81 was carried out by centrifugal force only.

[Common Experimental Conditions and Evaluation Indexes]

As the initial state of experiment, magnetic carrier of the previously described initial carrier amount (0.3 g/cubic centimeter (total amount=9.9 g)) was applied onto recovery roller 81. After printing 5,000 pages (paper sheet is A4 size) from the initial state, (1) surface state of recovery roller 81, (2) surface state of photoconductor 1, and (3) image noise of 5,000 print samples, were evaluated. With regard to (2), it was evaluated as "Poor" if a raised area having a cratered shape was observed, and as "Good" if the raised area having a cratered shape was not observed. With regard to (3), the evaluation was made based on the level of image noise, namely, "Poor" for the case in which the image noise was observed obviously, "Fair" for the case in which the image noise was observed lightly, and "Good" for the case in which the image noise was not observed. The results are shown in TABLE 3.

TABLE 3

| | (1) Surface state of recovery roller | (2) Surface state of photoconductor | (3) Image noise |
|---|---|---|---|
| Particular implementation No. 1 | No change from the initial stage. | Good | Good |
| Particular implementation No. 2 | No change from the initial stage. | Good | Good |
| Comparison example No. 1 | Smear by toner was observed. No scaring or toner adherence was observed. | Poor | Poor |
| Comparison example No. 2 | Smear by toner was observed. No scaring or toner adherence was observed. | Poor | Poor |
| Comparison example No. 3 | Scarring on sleeve surface was observed. Toner adherence was observed. | Poor | Fair |
| Comparison example No. 4 | Smear by toner was observed. No scaring or toner adherence was observed. | Poor | Poor |

In particular implementations No. 1 and No. 2, image deterioration such as image noise was not observed, and recovery roller 81 and photoconductor 1 had kept the same state as the initial state. In comparison example No. 3 in which a scraper was used in stead of separating member 82, toner adherence onto the surface of sleeve 81A was observed. The reason of the occurrence of image noise is contemplated that the surface of adhered toner was charged due to friction generated by the scraper and toner image being formed on photoconductor 1 was stirred by the electrical field which was disturbed by the charged toner. In comparison example No. 4 in which centrifugal force was only used to separate magnetic carrier, recovered magnetic carrier by main pole N2 was not separated substantially at separating pole N3 and was orbiting sleeve 81A again and magnetic carrier retained at main pole N2 became in the form of a chain (carrier chain), resulting in disturbance of toner image on photoconductor 1.

In particular implementations No. 1 and No. 2 according to the present invention, these problems were not observed and the recovery of magnetic carrier was successfully carried out even with the simple configuration of carrier recovery section.

[Curvature Radius R of Edge "eg"]

An experiment was carried out in particular implementation No. 2 by changing the curvature radius of edge "eg". Conditions other than the curvature radius were the same as these used in particular implementation No. 2. The state of magnetic carrier retained in the magnetic field formed by separating pole N3 and separating member 82 was observed (hereinafter, the magnetic field is referred to as "the field of retention"). The amount of magnetic carrier applied onto sleeve 81A was 0.3 g/cubic centimeter in initial state, and added thereafter.

The result is shown in TABLE 4. "Good" means that the magnetic carrier could retain in the field of retention and the magnetic carrier which slipped through downstream in the rotational direction of sleeve 81A was not observed. "Fair" means that the magnetic carrier could retain in the field of retention in the case of initial carrier amount, but, after magnetic carrier was added, the magnetic carrier which slipped through downstream in the rotational direction of sleeve 81A was observed. "Poor" means that the magnetic carrier could not retain in the field of retention.

TABLE 4

| Curvature radius R (mm) | Result |
|---|---|
| Less than 0.1 | Good |
| 0.3 | Good |
| 0.5 | Good |
| 0.6 | Fair |
| 0.7 | Poor |

As shown in TABLE 4, it is preferable that the curvature radius of edge "eg" be 0.5 mm or less.

What is claimed is:

1. An image forming apparatus comprising:

an image bearing member;

a developing device to develop a latent image formed on the image bearing member by a two-component developer comprising a toner and a magnetic carrier;

a transfer section to transfer a toner image formed on the bearing member onto a receiving member, and a carrier recovery section which is equipped with a recovery roller, the recovery roller being arranged in the rotational direction of the image bearing member and being disposed at such a position that is opposite to the image bearing member in a non-contact state downstream of the developing device and upstream of the transfer section, and a separating member to guide any magnetic carrier separated from the recovery roller, wherein the carrier recovery roller comprises a sleeve which is rotatable, and a magnet roller that is installed into an inner space of the sleeve and is provided with a plurality of fixed magnetic poles, the plurality of fixed magnetic poles comprises a main pole to recover the magnetic carrier from the image bearing member and a separating pole to separate the magnetic carrier from the recovery roller, wherein the separating member comprises a magnetic member comprising an edge, and is disposed at such a position that is opposite to the sleeve at a prescribed distance from the sleeve in a non-contact state, and the edge of the separating member, located downstream of the direction of rotation of the sleeve, is disposed in a magnetic field formed by the separating pole and is disposed downstream from the peak value position of the magnetic flux density in the normal direction on the surface of the sleeve.

2. The image forming apparatus of claim 1, wherein the separating member comprises a plate-like tabular member.

3. The image forming apparatus of claim 1, wherein the separating member is arranged in such a state in which an edge of the separating member near the sleeve is facing counter to the rotational direction of the sleeve.

4. The image forming apparatus of claim 1, wherein the edge of the separating member is disposed in a magnetic field formed by the separating pole and a part of the edge of the separating member is disposed downstream area of the rotational direction of the sleeve.

5. The image forming apparatus of claim 1, wherein the separating member comprises an inclined surface which is opposite to the sleeve and the inclined surface is approximately parallel to the direction of tangent of the sleeve at the pole position of the separating pole.

6. The image forming apparatus of claim 1, wherein the carrier recovery section comprises a conveyance mechanism to convey the magnetic carrier separated from the recovery roller.

7. The image forming apparatus of claim 6, wherein the conveyance mechanism comprises a conveyance screw to convey the magnetic carrier in the direction of rotational axis, and the carrier recovery section comprises a storage space adjacent to the conveyance screw, the storage space is arranged between the developing device and the recovery roller, and some of the magnetic carrier conveyed in the direction of the rotational axis by the conveyance screw is stored in the storage space.

8. The image forming apparatus of claim 1, wherein a storage space is arranged between the developing device and the recovery roller.

9. The image forming apparatus of claim 1, wherein, in the state that the separating member is arranged, the boundary between the line of magnetic force towards downstream side from the separating pole and the line of magnetic force towards upstream side from the separating pole, passes the separating member.

10. The image forming apparatus of claim 1, wherein the edge is the contacting side where two surfaces of the separating member, which are extending in the direction of rotational axis of the recovery roller, contact each other, and wherein the reverse side of the surface that is opposite to the recovery roller comprises an inclined surface extending in the direction downward.

11. The image forming apparatus of claim 1, wherein the separating member comprises a plate-like tabular member, and is arranged with an inclined surface extending in the direction downward with said edge at the top of the separating member.

12. The image forming apparatus of claim 1, wherein the radius of curvature of the edge of the separating member is 0.5 mm or less.

* * * * *